US008950449B2

(12) United States Patent
Ruff et al.

(10) Patent No.: US 8,950,449 B2
(45) Date of Patent: Feb. 10, 2015

(54) FLITCH SURFACING APPARATUS

(75) Inventors: Arlington Ruff, Negley, OH (US); Clifford Ruff, Negley, OH (US); Mark J. Zirnheld, Buffalo, NY (US); Michael T. Smith, North Tonawanda, NY (US)

(73) Assignee: Merritt Machinery, LLC, Lockport, NY (US)

( * ) Notice: Subject to any disclaimer, the term of this patent is extended or adjusted under 35 U.S.C. 154(b) by 1073 days.

(21) Appl. No.: 12/960,143

(22) Filed: Dec. 3, 2010

(65) Prior Publication Data

US 2011/0132494 A1 Jun. 9, 2011

Related U.S. Application Data

(60) Provisional application No. 61/266,679, filed on Dec. 4, 2009.

(51) Int. Cl.

| | |
|---|---|
| ***B27L 1/00*** | (2006.01) |
| ***B27L 1/10*** | (2006.01) |
| ***B27C 5/08*** | (2006.01) |

(52) U.S. Cl.

CPC .... *B27L 1/10* (2013.01); *B27C 5/08* (2013.01)
USPC ..... 144/208.1; 142/49; 144/117.1; 144/118

(58) Field of Classification Search

CPC ..... B27C 1/02; B27C 1/14; B27C 1/04
USPC ..... 144/208.1–208.9, 115, 117.1, 131, 118, 144/135.3, 135.4, 334, 24.12, 237, 46, 47, 144/172; 142/49, 47
See application file for complete search history.

(56) References Cited

U.S. PATENT DOCUMENTS

| | | | |
|---|---|---|---|
| 1,337,286 | A | 4/1920 | Stadig |
| 1,673,265 | A | 6/1928 | Pangborn |
| 1,956,653 | A | 5/1934 | Onstad |
| 2,591,751 | A | 4/1952 | Whitlock |
| 2,725,908 | A | 12/1955 | Ednell et al. |
| 2,739,627 | A | 3/1956 | Voehringer |
| 2,780,252 | A | 2/1957 | Gyllenberg |
| 2,794,465 | A | 6/1957 | Gyllenberg |
| 2,799,304 | A | 7/1957 | Stewart |
| 2,834,385 | A | 5/1958 | Gyllenberg |

(Continued)

FOREIGN PATENT DOCUMENTS

| | | |
|---|---|---|
| EP | 0542194 | 5/1997 |
| GB | 912673 | 12/1962 |

(Continued)

*Primary Examiner* — Shelley Self
*Assistant Examiner* — Matthew G Katcoff
(74) *Attorney, Agent, or Firm* — Simpson & Simpson, PLLC

(57) ABSTRACT

A cutter head for surfacing a flitch, the cutter head including a shaft, a blade non-rotatably mounted on the shaft, wherein the flitch is surfaced by rotating the blade, a bushing including a bore, wherein the shaft runs through the bore, wherein a flange is eccentrically formed about the bore, a guide mounted on the flange of the bushing, wherein the flange axially offsets the guide with respect to the shaft, wherein the guide is arranged to support the cutter head against the flitch while the cutter head is surfacing the flitch, and wherein a radial distance between a tip of the blade and the guide determines a cutting depth of the cutter head, and wherein due to the guide being mounted on the eccentrically formed flange, the radial offset is determined based on a rotational orientation of the bushing about the shaft.

18 Claims, 14 Drawing Sheets

(56) References Cited

U.S. PATENT DOCUMENTS

| | | | | |
|---|---|---|---|---|
| 2,857,945 | A | 10/1958 | Brundell et al. | |
| 2,880,771 | A | 4/1959 | Annis, Jr. | |
| 2,897,859 | A | 8/1959 | Annis, Jr. | |
| 2,899,993 | A | 8/1959 | Durant | |
| 2,903,028 | A | 9/1959 | Brundell et al. | |
| 2,934,111 | A | 4/1960 | Gyllenberg | |
| 3,008,503 | A | 11/1961 | Hilborn | |
| 3,351,107 | A | 11/1967 | Hamilton | |
| 3,509,922 | A | 5/1970 | Lundberg | |
| 3,668,971 | A | 6/1972 | Dever | |
| 3,789,893 | A | 2/1974 | Carson et al. | |
| 3,913,644 | A | 10/1975 | Braun | |
| 4,086,944 | A | 5/1978 | Traben | |
| 4,122,877 | A | 10/1978 | Smith et al. | |
| 4,143,692 | A | 3/1979 | Traben | |
| 4,230,163 | A | 10/1980 | Barton | |
| 4,231,694 | A | 11/1980 | Unigovsky et al. | |
| 4,303,111 | A | 12/1981 | Neville | |
| 4,522,242 | A | 6/1985 | Hutson | |
| 4,562,873 | A | 1/1986 | Kroecher et al. | |
| 4,589,174 | A | 5/1986 | Allen | |
| 4,589,456 | A | 5/1986 | Traben | |
| 4,653,561 | A | 3/1987 | Payeur | |
| 4,673,012 | A | 6/1987 | O'Brien, Jr. et al. | |
| 4,858,301 | A | 8/1989 | Galarowic | |
| 4,875,511 | A | 10/1989 | Wingate-Hill et al. | |
| 5,070,919 | A | 12/1991 | Ackerman | |
| 5,070,920 | A | 12/1991 | Morey | |
| 5,201,354 | A * | 4/1993 | Weissbeck | 144/245.2 |
| 5,247,977 | A | 9/1993 | Munsey et al. | |
| 5,297,601 | A | 3/1994 | Munsey et al. | |
| 5,458,172 | A | 10/1995 | Rautio | |
| 5,611,130 | A | 3/1997 | Rummell et al. | |
| 5,722,475 | A | 3/1998 | Lammi | |
| 5,743,315 | A * | 4/1998 | Esposito et al. | 144/334 |
| 6,135,174 | A | 10/2000 | Neville | |
| 6,223,413 | B1 | 5/2001 | Crocker et al. | |
| 6,474,379 | B1 | 11/2002 | Mellor et al. | |
| 6,539,993 | B1 | 4/2003 | Starr | |
| 6,776,202 | B1 | 8/2004 | Dziesinski et al. | |
| 6,971,423 | B2 | 12/2005 | Starr | |
| 7,131,471 | B2 | 11/2006 | McIntosh | |
| 7,243,693 | B1 | 7/2007 | Mellott | |
| 7,841,373 | B2 | 11/2010 | Rastatter et al. | |
| 2003/0029519 | A1 | 2/2003 | Starr | |
| 2003/0102052 | A1 | 6/2003 | Lines | |
| 2003/0226617 | A1 | 12/2003 | Choquette | |
| 2005/0121106 | A1 | 6/2005 | Rastatter et al. | |
| 2006/0048852 | A1 | 3/2006 | McIntosh | |
| 2007/0157994 | A1 | 7/2007 | Scoville et al. | |
| 2007/0261762 | A1 | 11/2007 | Eriksson | |
| 2008/0283149 | A1 | 11/2008 | Rastatter et al. | |
| 2011/0041668 | A1 | 2/2011 | Rastatter et al. | |

FOREIGN PATENT DOCUMENTS

| | | | |
|---|---|---|---|
| GB | 2 021 019 | A | 11/1979 |
| JP | 2008149725 | | 7/2008 |
| WO | 9218305 | | 10/1992 |
| WO | 03070440 | | 8/2003 |
| WO | 2007056397 | A2 | 5/2007 |

* cited by examiner

FLITCH SURFACING APPARATUS

CROSS-REFERENCE TO RELATED APPLICATIONS

This patent application claims the benefit under 35 U.S.C. §119(e) of U.S. Provisional Patent Application No. 61/266,679 filed Dec. 4, 2009, which application is incorporated herein by reference.

FIELD OF THE INVENTION

The invention broadly relates to log processing apparatuses, more specifically to flitch processing apparatuses, and even more particularly to a flitch surfacing apparatus.

BACKGROUND OF THE INVENTION

Flitches, or logs split longitudinally in half, are known for a variety of uses, such as to be sliced into thin layers for forming veneers for products like cabinets, doors, flooring, and furniture. To form a flitch, a log is typically first stripped of its bark using any number of methods. The stripped logs are then cut longitudinally in half. Between the bark stripping and longitudinal cutting operations, the flitches often get dirt, grime, oil, and the like from those operations coated on and partially impregnated into the outer circumferential surface of the flitch. Thus, before the flitch can be further processed, such as into slices as veneers, the flitch must be "surfaced". By surfaced, it is meant that the dirty and/or soiled surface of the flitch is removed in order to clean the flitch.

Traditionally, workers would manually remove the outer surface of the flitch with hand-held rotary grinding tools. To improve throughput and reduce labor costs, it has been desirable to automate the process. However, these systems have been found to be overly complex, prone to mechanical failure and in need of constant repair. Additionally, it has been found that these systems remove an unnecessary amount material while surfacing a flitch which reduces the amount of the flitch that can be processed into a finished product, such as veneers. For one example, see United States Patent Publication No. 2005/0121106 (Rastatter et al.), which U.S. patent Publication is hereby incorporated by reference in its entirety.

BRIEF SUMMARY OF THE INVENTION

The present invention broadly comprises a cutter head for surfacing a flitch, the cutter head including a shaft, a blade non-rotatably mounted on the shaft, wherein the flitch is surfaced by rotating the blade, a bushing including a bore, wherein the shaft runs through the bore, wherein a flange is eccentrically formed about the bore, a guide mounted on the flange of the bushing, wherein the flange axially offsets the guide with respect to the shaft, wherein the guide is arranged to support the cutter head against the flitch while the cutter head is surfacing the flitch, and wherein a radial distance between a tip of the blade and the guide determines a cutting depth of the cutter head, and wherein due to the guide being mounted on the eccentrically formed flange, the radial offset is determined based on a rotational orientation of the bushing about the shaft.

In one embodiment, the at least one bushing comprises first and second bushings, wherein the leading guide is mounted on the first bushing and a trailing guide is mounted on the second bushing. In one embodiment, the trailing guide is arranged substantially flush with the tip of the blade.

In one embodiment, the invention further comprises a cutter assembly including the cutter head mounted on a platform. In one embodiment, the shaft is coupled to a motor for rotating the shaft, and wherein the motor is mounted on the platform. In one embodiment the cutter head is attached to a cutter frame via a float pin, wherein the float pin is arranged substantially perpendicular to the shaft and enables the cutter head to rotate in order for the cutter head to follow longitudinal contours of the flitch.

In one embodiment, a locking device is included between the cutter frame and the cutter head for limiting rotation of the cutter head about the float pin. In one embodiment, the locking device includes an actuator secured to cutter frame and a plate having a wedge-shaped opening functionally secured to the cutter head, wherein the actuator is operatively arranged to set a position of a locking pin relative to the wedge-shaped opening, wherein the position of the locking pin with respect to the wedge shaped opening defines how far the cutter head can rotate about the float pin. In one embodiment, the cutter frame includes a first long stroke actuator and at least one second short stroke actuator for moving the cutter head towards and away from the flitch.

In one embodiment, the invention further comprises an apparatus for surfacing a flitch including at least one cutter assembly as recited above, the apparatus including an infeed section including a centering device for centering the flitch in the apparatus along a longitudinal axis, an outfeed section for holding the flitch after it has been surfaced, and a cutting section for surfacing the flitch, wherein the cutting section includes a carriage arranged to travel along a substantially semicircular track, the semicircular track concentrically aligned with the flitch and the longitudinal axis, wherein the at least one cutter assembly is secured to carriage and operatively arranged to surface the flitch as the carriage traverses along the semicircular track.

In one embodiment, the at least one cutter assembly includes first and second cutter assemblies, wherein the first and second cutter assemblies are secured to the carriage such that the first and second cutter assemblies are arranged substantially perpendicular to each other. In one embodiment, the first and second cutter assemblies simultaneously surface the outer circumferential surface of the flitch, and wherein the carriage travels approximately 90 degrees along the semicircular track for surfacing essentially an entirety of the outer circumferential surface of the flitch, with each of the first and second cutter assemblies surfacing approximately one-half of the outer circumferential surface of the flitch.

In one embodiment, the cutter head of the cutter assembly is mounted on a platform and coupled to a motor for rotating the shaft of the cutter head, and wherein the motor is also mounted on the platform. In one embodiment, the cutter head is attached to a cutter frame via a float pin, wherein the float pin is arranged substantially perpendicular to the shaft and enables the cutter head to rotate in order for the cutter head to follow longitudinal contours of the flitch. In one embodiment, a locking device is included between the cutter frame and the cutter head for limiting rotation of the cutter head about the float pin.

In one embodiment, the locking device includes an actuator secured to cutter frame and a plate having a wedge-shaped opening functionally secured to the cutter head, wherein the actuator is operatively arranged to set a position of a locking pin relative to the wedge-shaped opening, wherein the position of the locking pin with respect to the wedge shaped opening defines how far the cutter head can rotate about the float pin. In one embodiment, the cutter frame includes a long stroke actuator and a pair of short stroke actuators for moving the cutter head towards and away from the flitch, wherein the long stroke actuator is actuated to initially bring the cutter head against the flitch and to finally bring the cutter head away from the flitch after the flitch is fully surfaced, and wherein the pair of short stroke actuators is actuated to pull the cutter head a set distance away from the flitch after each traversal of the carriage along the semicircular track and to push the cutter head back toward the flitch by the set distance after each indexing of the flitch before a subsequent traversal of the carriage along the track. In one embodiment, the cutting section includes a stop pin arranged at least partially or tangentially on the longitudinal axis for preventing a shifting of the flitch out of alignment with the longitudinal axis while the flitch is being subjected to forces by the cutter head as the carriage traverses the semicircular track about the flitch.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. It should be appreciated that the term "flitch" generally refers to any longitudinally cut log that is generally semi-circular in cross-section (although the top rounded portion of the flitch is generally flattened off so that the top surface is parallel to the bottom surface). See for example, Rastatter et al., incorporated by reference supra. As used generally herein, "flitch" shall also refer to a half-flitch, resembling a quarter of a circle in cross-section, or any other portion of a flitch or log that could be surfaced as described herein. Furthermore, some Figures may include a set of coordinate axes thereon. The coordinate axes are arranged perpendicular to each other, with the y-direction generally representing a vertical direction, and the x and z-directions generally representing perpendicular horizontal directions, with the outer circumference formed as an arc in the y and z-directions and the flitch being longitudinally aligned in the x-direction, although it should be understood that these directions are merely to describe a frame of reference for the sake of discussion of embodiments of the current invention. Although any methods, devices or materials similar or equivalent to those described herein can be used in the practice or testing of the invention, the preferred methods, devices, and materials are now described.

Figure 1:
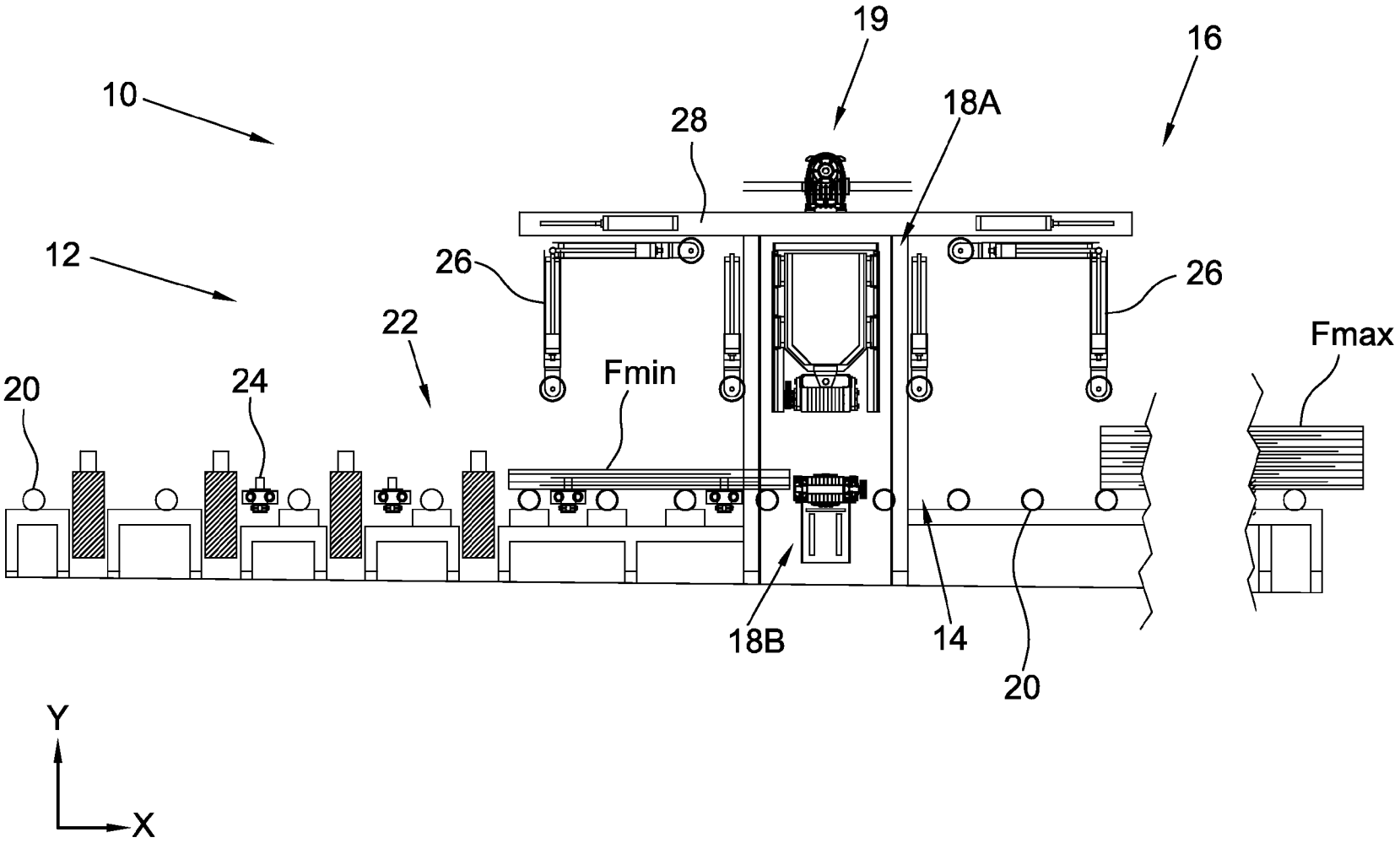
FIG. 1 is a side view of a flitch surfacing apparatus.
Figure 2:
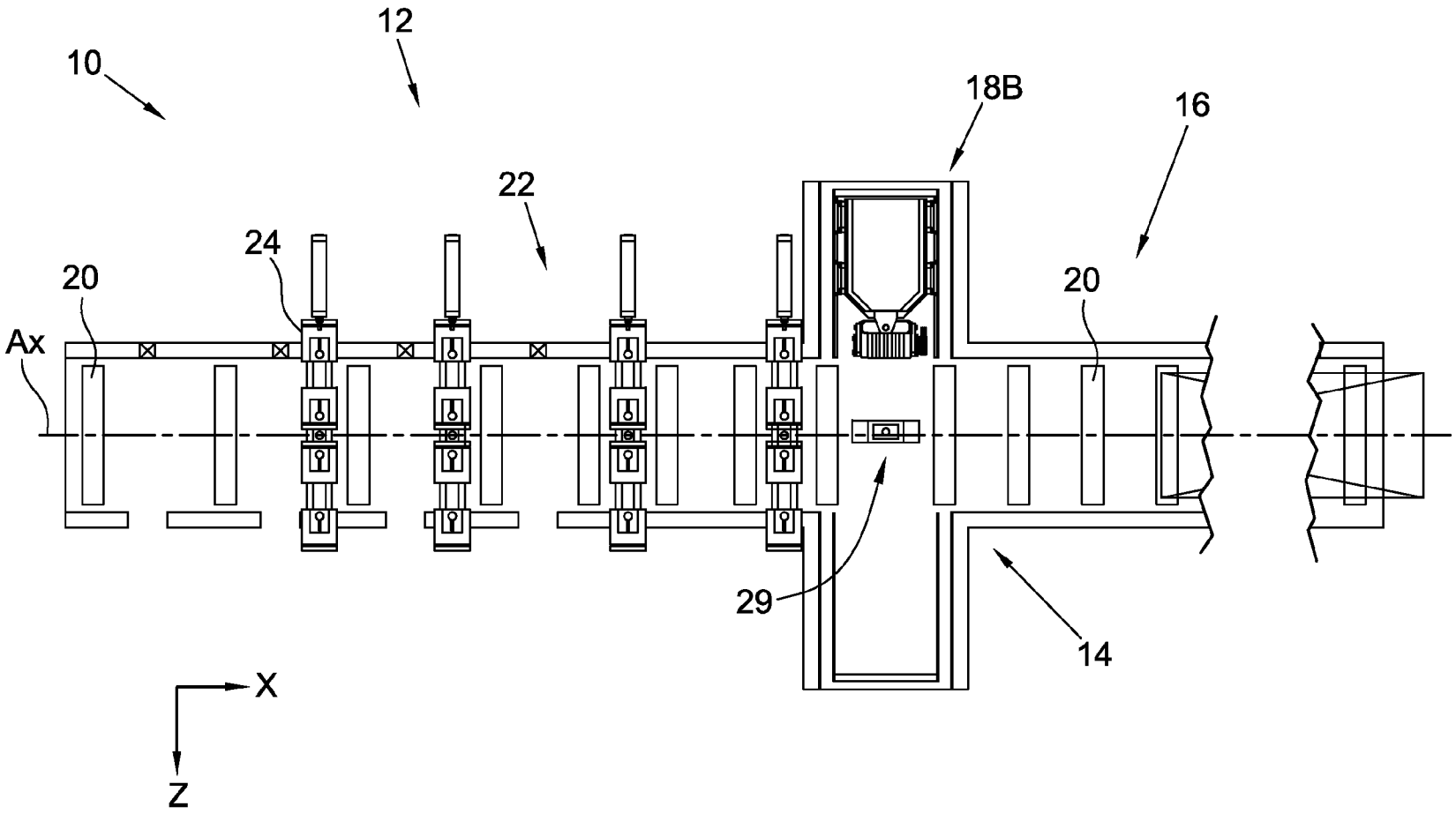
FIG. 2 is a top view of a the flitch surfacing apparatus of FIG. 1.

Referring now to the figures, FIGS. 1 and 2 show a side view and top view of flitch surfacing apparatus 10, respectively. Flitches F are placed on apparatus 10 at infeed section 12, where they are passed through cutting or surfacing section 14 to outfeed section 16 after they have been surfaced by cutting assemblies 18 in surfacing section 14. Two differently sized flitches are shown, particularly an approximately maximum sized flitch that can be effectively surfaced by apparatus 10 designated Fmax, and an approximately minimum sized flitch that can be effectively surfaced by apparatus 10 designated Fmin. There are two cutting assemblies 18 shown throughout the Figures, with a first cutting assembly labeled 18A and shown arranged in an initially vertical orientation and a second cutting assembly labeled 18B and shown arranged in an initially horizontal orientation. The cutting assemblies are powered by driving system 19, and both will be described in more detail infra. Infeed section 12 and outfeed section 16 both include a plurality of conveyors or rollers 20 on which the flitches can progress through apparatus 10. The conveyors can be chain driven, belt driver, or the like, such that the flitches can be progressed through apparatus 10 by at least one motor, or some other driving means.

Infeed section 12, where the unsurfaced flitches are first loaded, includes centering assembly 22 for centering the flitches on conveyors 20 so that they are properly aligned to be surfaced by cutting assemblies 18. That is, with respect to the axes shown in the Figures, the flitches are centered in the z-direction by use of centering assembly 22. By centering the z-direction the flitch is aligned longitudinally or lengthwise along axis Ax, which extends in the x-direction as shown. The centering assembly comprises at least one centering device 24, with four centering devices shown in FIGS. 1 and 2, although it should be appreciated that any number of centering devices could be used. The centering devices will be described in more detail infra.

Figure 20:
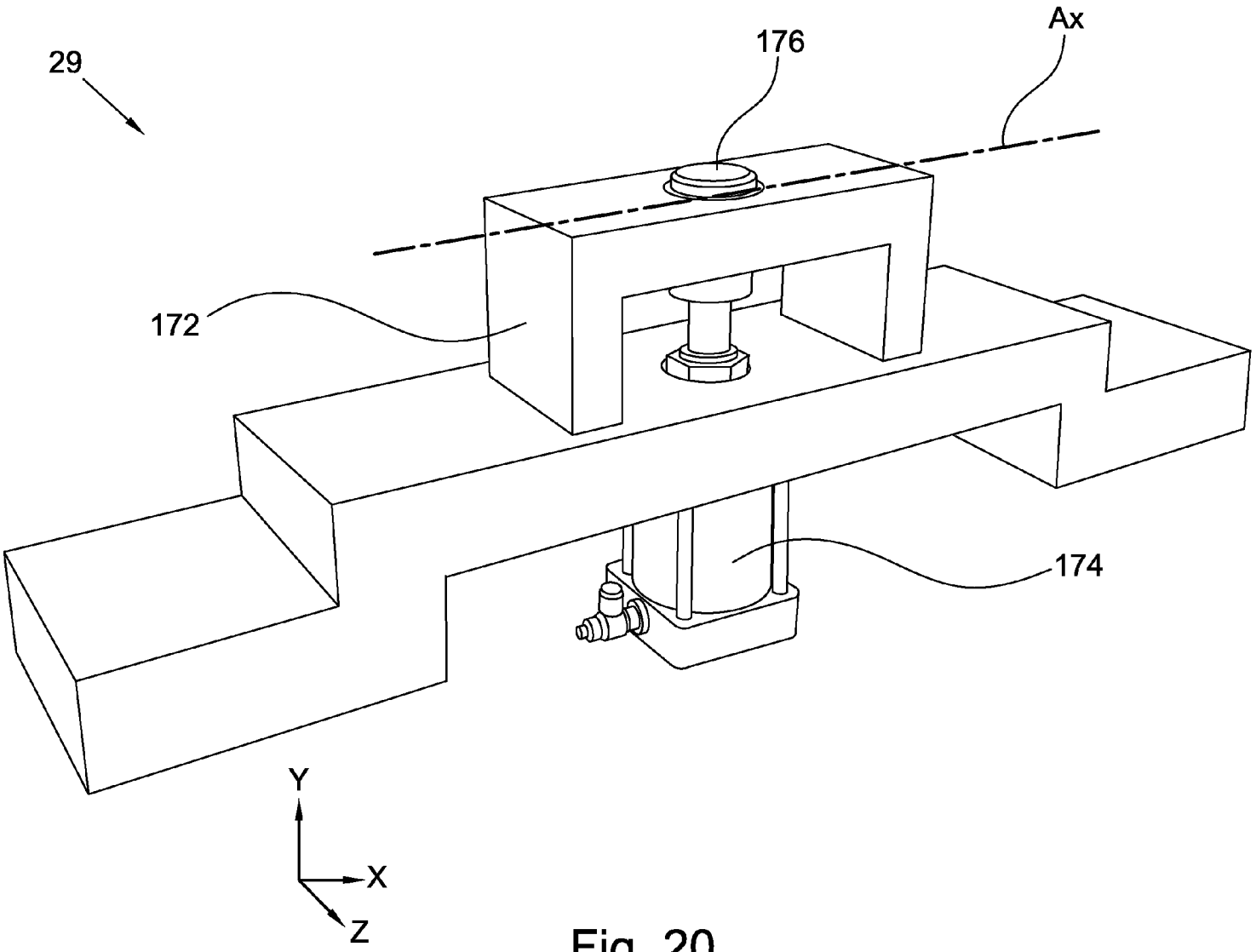

After a flitch has been centered by centering assembly 22, it is progressed toward cutting section 14 by rollers 20. As the flitch approaches the cutting section, hold-downs, or hold-down arms 26 are deployed to exert a generally downward force on the flitch in order to steady the flitch while it is being surfaced. The hold-down arms could swing down from a generally horizontal orientation to a vertical orientation (as shown with the outermost two arms), or the arms could be extendable, such as by hydraulics, in order to exert a force on the flitches. It has been found that vertically orientated pneumatically extendable arms work suitably well, and the hold-down arms will be described in further detail infra. Beam 28 extends down the length of apparatus 10 from the infeed to the outfeed. Arms 26 are secured, for example, to beam 28. Cutting assemblies 18, more specifically the framework for cutting assemblies 18, may also be connected to beam 28 as described in more detail below. Half-flitch support 29 will be described in more detail infra with respect to FIG. 20. It should be noted that one of cutting assembly 18A, driving system 19, hold-downs 26, and beam 28 have been removed from FIG. 2 for clarity of the other components.

Generally, the flitch is centered in the z-direction then moved by infeed 12 into surfacing section 14 such that cutting assemblies 18A and/or 18B can remove a longitudinal strip of the flitch's outer circumferential surface. The flitch is then indexed, or moved forward in the x-direction a set distance such that the portion of the flitch that has been surfaced is moved to outfeed 16, and a portion of unsurfaced flitch is positioned for a second longitudinal strip of circumferential outer surface to be removed from the flitch. This process is repeated in increments along the entire longitudinal length of the flitch until the entire surface of the flitch has been cleaned by removing one strip at a time.

Figure 3:
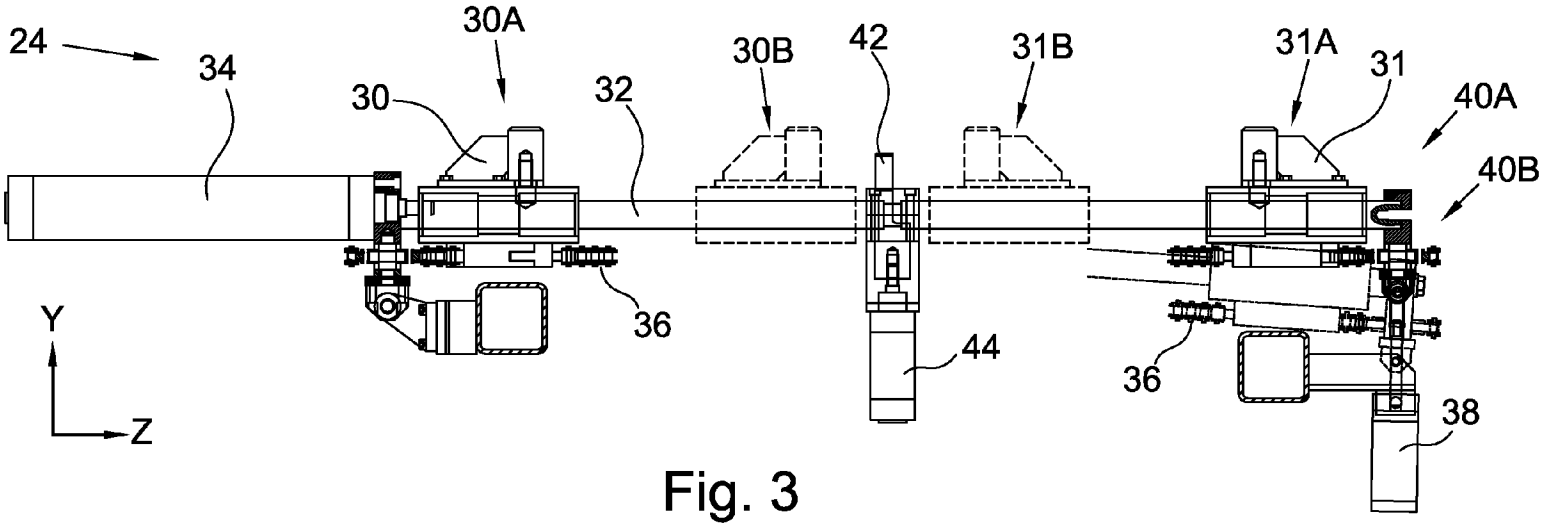
FIG. 3 is a side view of a centering device for a flitch surfacing apparatus.
Figure 4:
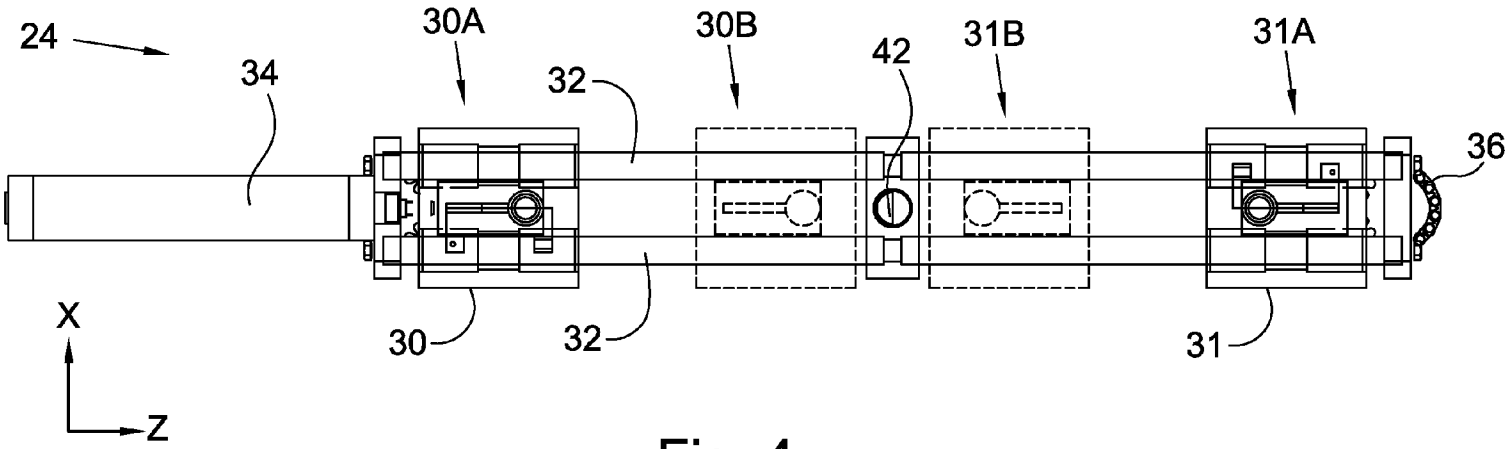
FIG. 4 is a top view of the centering device of FIG. 3.

Cutting devices 24 are shown in greater detail in FIGS. 3 and 4, which are side and top views of the cutting devices, respectively. In order to center the flitches in the infeed area before the flitches are surfaced, centering device includes a pair of cassettes 30 and 31 which are mounted slidably on rail or rails 32. As shown, cassette 30 is moveable along rails 32 between retracted position 30A and deployed position 30B, while cassette 31 is moveable along rails 32 between retracted position 31A and deployed position 31B. The cassettes are deployed and retracted by actuator 34, which may be a typical hydraulic or pneumatic actuator having a deployable plunger rod connected to cassette 30. In order for cassette 31 to move synchronously with cassette 30, the cassettes are connected together by chain 36, which sets a position of cassette 31 based on the position of cassette 30 set by actuator 34. Chain 36 is shown truncated, although it should be understood that the chain connects between both cassettes. Thus, by driving cassette 30 from position 30A toward position 30B, cassette 31 is synchronously driven from position 31A to position 31, and the synchronized movement of the cassettes results in the cassettes pushing the flitch into the center of the conveyors.

In FIG. 3, it is additionally shown that the side of centering device 24 including cassette 31 is moveable by actuator 38 in the vertical, or y-direction, and pivotable on the opposite side at a pivot point below actuator 34, which may be, for example, a pin. The deployed and retracted positions of actuator 38 are designated 40A and 40B, respectively, with a portion of the centering device in position 40B shown in phantom lines. When not in use, centering device 24 assumes position 40B so that it will not interfere with the progress of a flitch through apparatus 10. When it is desired for the centering device to center a flitch, actuator 38 sets the centering device into position 40A, so that the cassettes are at a proper height to engage against the flitch for pushing the flitch into the center of the conveyors. Several centering devices are included in centering assembly 22 to ensure that the flitch is centered along its entire length, although a different number of centering devices may be included, or centering could be achieved by some other method.

Also shown in FIGS. 3 and 4 is semi-circular pin 42 attached to the plunger rod of actuator 44. Pin 42 is used in the event that a half-flitch is to be surfaced. By half-flitch it is meant a flitch that has been cut longitudinally in half so that it resembles a quarter-circle in cross-section as opposed to a semicircle. Thus, the half-flitch has two substantially flat surfaces that are perpendicularly arranged, and one rounded surface that spans between the two perpendicular flat surfaces. Thus, pin 42 can be deployed, as shown, such that a vertically oriented flat surface of the half-flitch is pressed against pin 42 by one of cassettes 30 or 31 (e.g., in the embodiment shown in FIGS. 3 and 4, pin 42 faces cassette 31). By positioning the surface of pin 42 on longitudinal axis Ax, the half-flitch can be longitudinally aligned along axis Ax.

Figure 5:
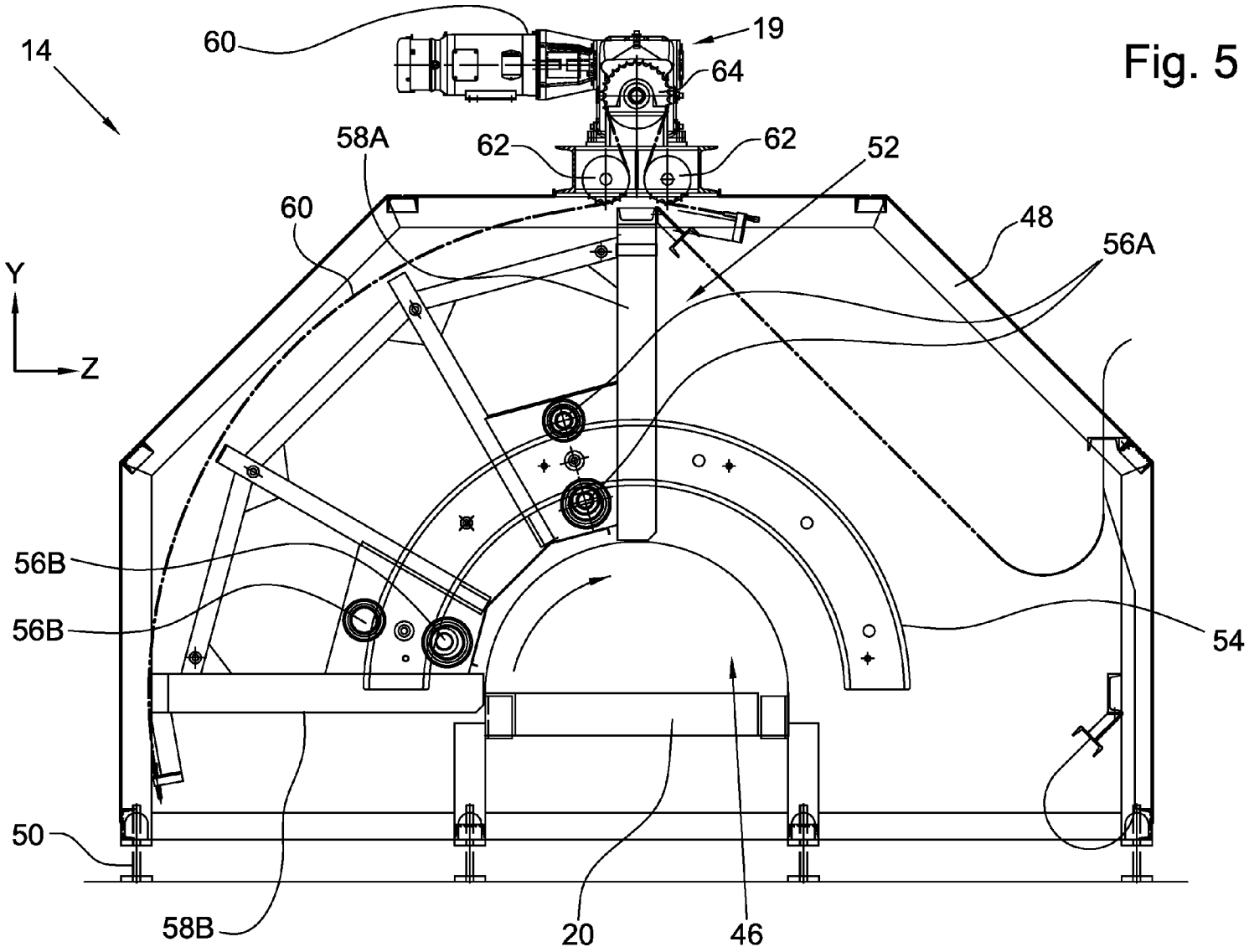
FIG. 5 is a front view of a cutting section of the flitch surfacing apparatus of FIGS. 1 and 2.

Cutting section 14 is shown in more detail in FIG. 5, which is a front view of the cutting section. Specifically, it can be seen that semi-circular shaped opening 46 is formed above conveyor 20 and outlined by framework 48, through which opening the flitch passes. Framework 48 is constructed generally of beams and is adjustable on adjustable feet 50 for supporting the weight of carriage 52 and aligning or balancing the carriage with respect to the conveyors or the horizontal. Some vertical and horizontal cross-beams have been removed from framework 48 as shown in FIG. 5 so that carriage 52 can be seen more clearly. Carriage 52 is arranged to carry cutter assemblies 18 (not shown in FIG. 5) along a substantially semi-circular path around the top and sides of the flitch. For example, track 54 forms a curved path about opening 46 along which carriage 52 can travel by means of wheels 56, which are positioned to support carriage 52 on opposite sides of track 54, which may be formed as a plate or other protrusion secured to framework 48 (such as via additional beams of framework 48 which are not shown).

Wheels 56 are shown designated as wheels 56A and 56B because it is intended for carriage 52 to carry two cutting assemblies 18A and 18B, with wheels 56A being included proximate to the first cutting assembly and with wheels 56B proximate to the second cutting assembly such that each set of wheels supports its respective cutting assembly. Specifically, plate 58A of carriage 52 is included to secure to first cutting assembly 18A and plate 58B is included to secure to second cutting assembly 18B, which arrangement will be more fully described infra.

The carriage is driven along the curved track by driving system 19, which takes the form of motor 60 in the shown embodiment. Motor 60 is coupled to the carriage via chain 62, which is concentrically aligned with semicircular opening 46, curved track 54, and axis Ax. The chain is supported for example, by pinions 64 and driven by pinion 66, which is connected to the rotational output of motor 60. The motor is reversible for driving carriage 52 in both directions rotationally about semi-circular opening 46. Chain 62 is secured to carriage 52 and only spans approximately 90 degrees about central axis Ax, in order to, for example, limit inadvertent over rotation of carriage 52. As indicated by the orientation of plates 58A and 58B to which the cutting assemblies attach, the cutting assemblies are arranged perpendicularly with respect to each other. Effectively, travel by the carriage transitions one of the cutting assemblies from a vertical orientation to a horizontal orientation and the other of the cutting assemblies from a horizontal orientation to a vertical orientation. It should be appreciated that with two cutting assemblies, carriage 52 only needs to rotate 90 degrees and the full 180 degree strip of the outer surface of the flitch can be surfaced. The flitch can then be indexed, or moved forward a set amount, and the motor reversed for driving the carriage back to its starting position for removing another strip of material from the flitch. This process can then be repeated down the entire length of the flitch until the entire circumferential outer surface of the flitch has been surfaced. It should be appreciated that a single cutting assembly could be used that traverses the full 180 degrees, however, it would take the cutting assembly twice as long to travel this distance as opposed to the current arrangement.

Figure 6:
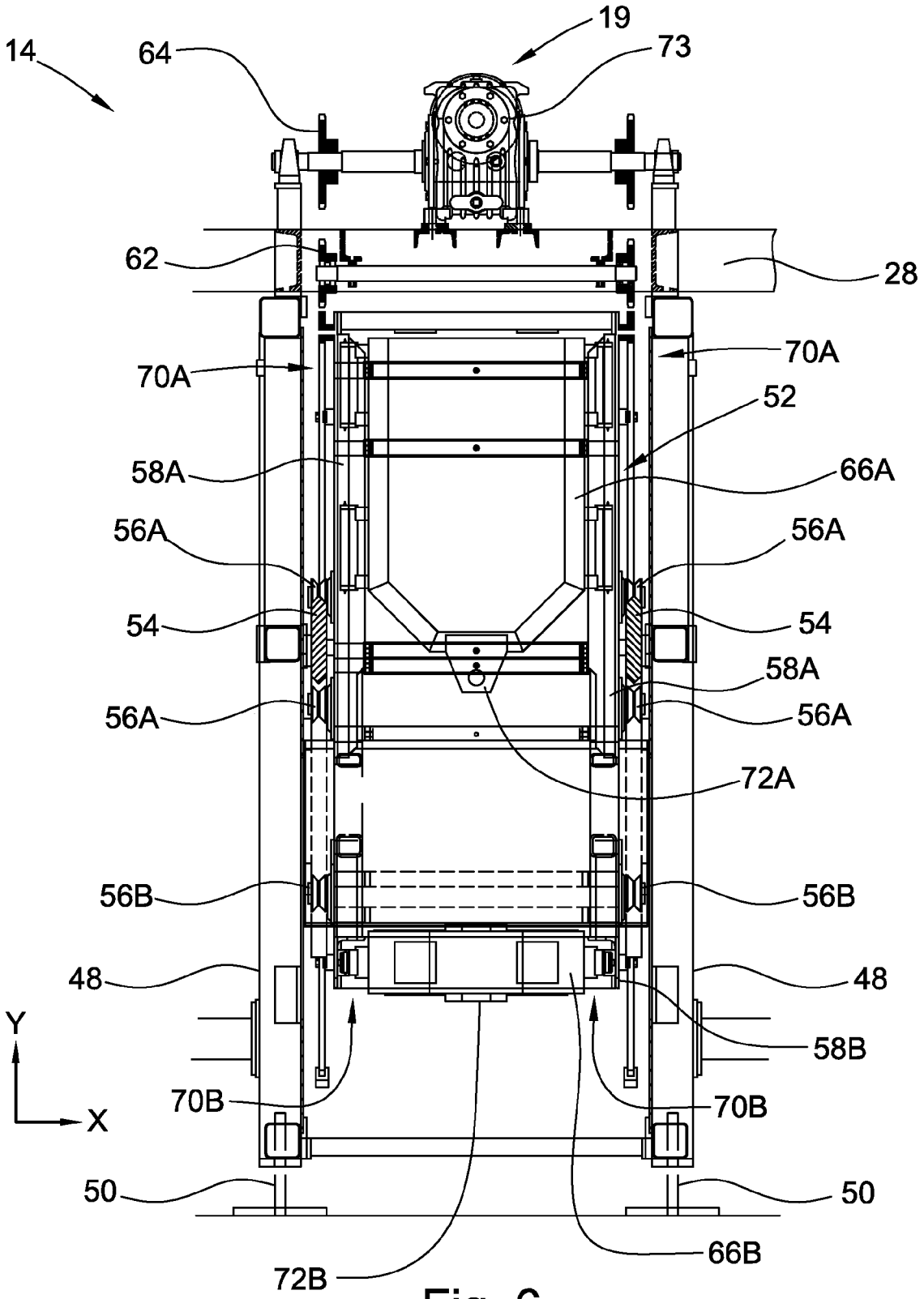
FIG. 6 is a side view of the cutting section shown in FIG. 5.

FIG. 6 shows a side view of cutting section 14. In this Figure, it can be seen that framework 48 is formed as on both sides of cutter frames 66A and 66B and that the cutter frames are engaged with rails 58. In the currently described embodiment, cutter frames 66A and 66B are slidably mounted in rails 58 at slidable connections 70A and 70B, respectively. Cutter frames 66A and 66B connect to cutter assemblies 18A and 18B respectively via plates 72A and 72B, as will be described in more detail infra (see, for example, FIG. 7). It can also be seen in FIG. 6 how wheels 56A and 56B surround opposite sides of track 54 for supporting the cutter assemblies, although some wheels 56B are hidden from view behind the track. At the top of FIG. 6, it can be seen that motor 60 includes disk brake 73 for stopping the motor, and therefore the carriage and cutter assemblies, in case of an emergency, for example.

Figure 7:
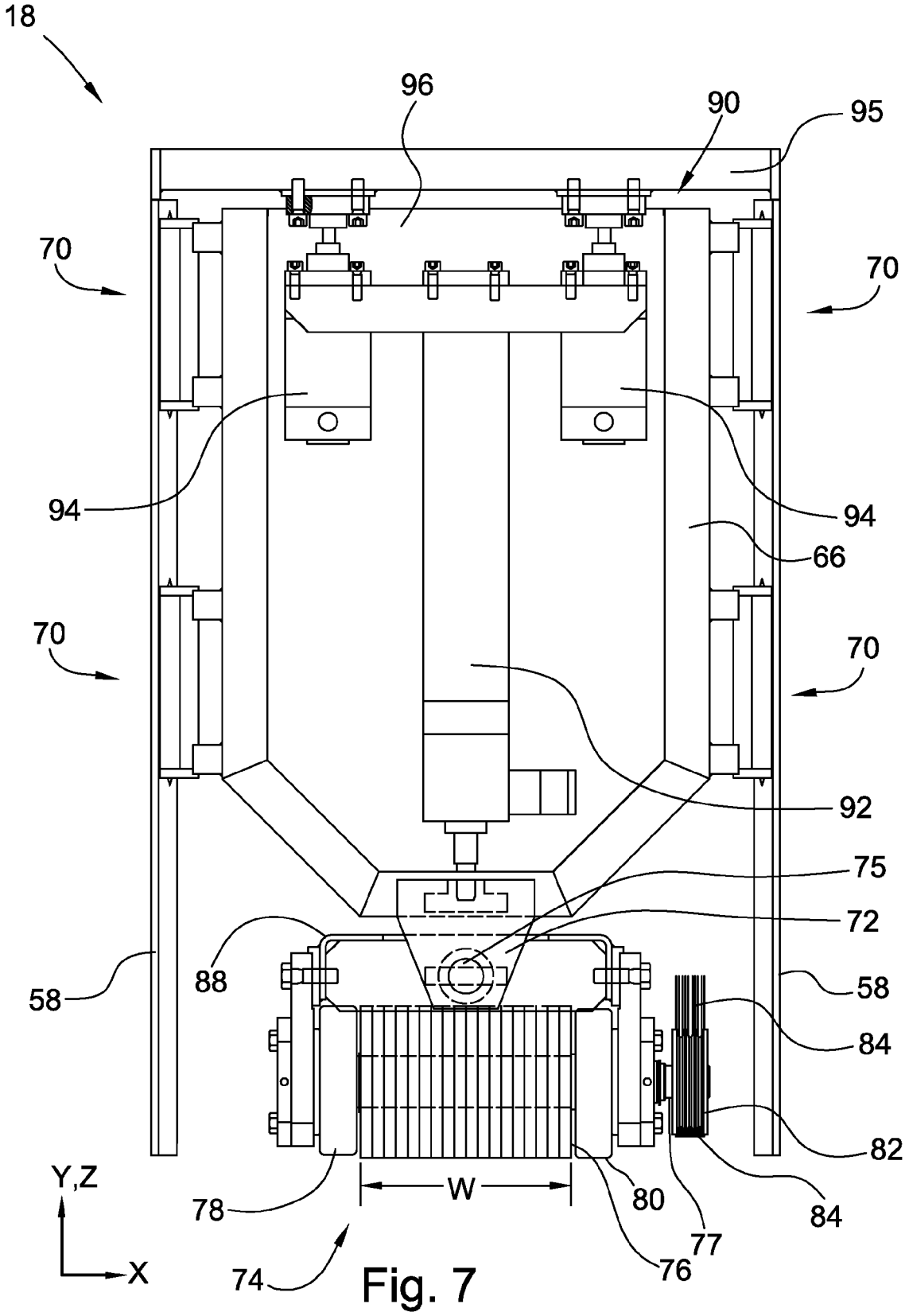
FIG. 7 is a front view of a cutter assembly.
Figure 8:
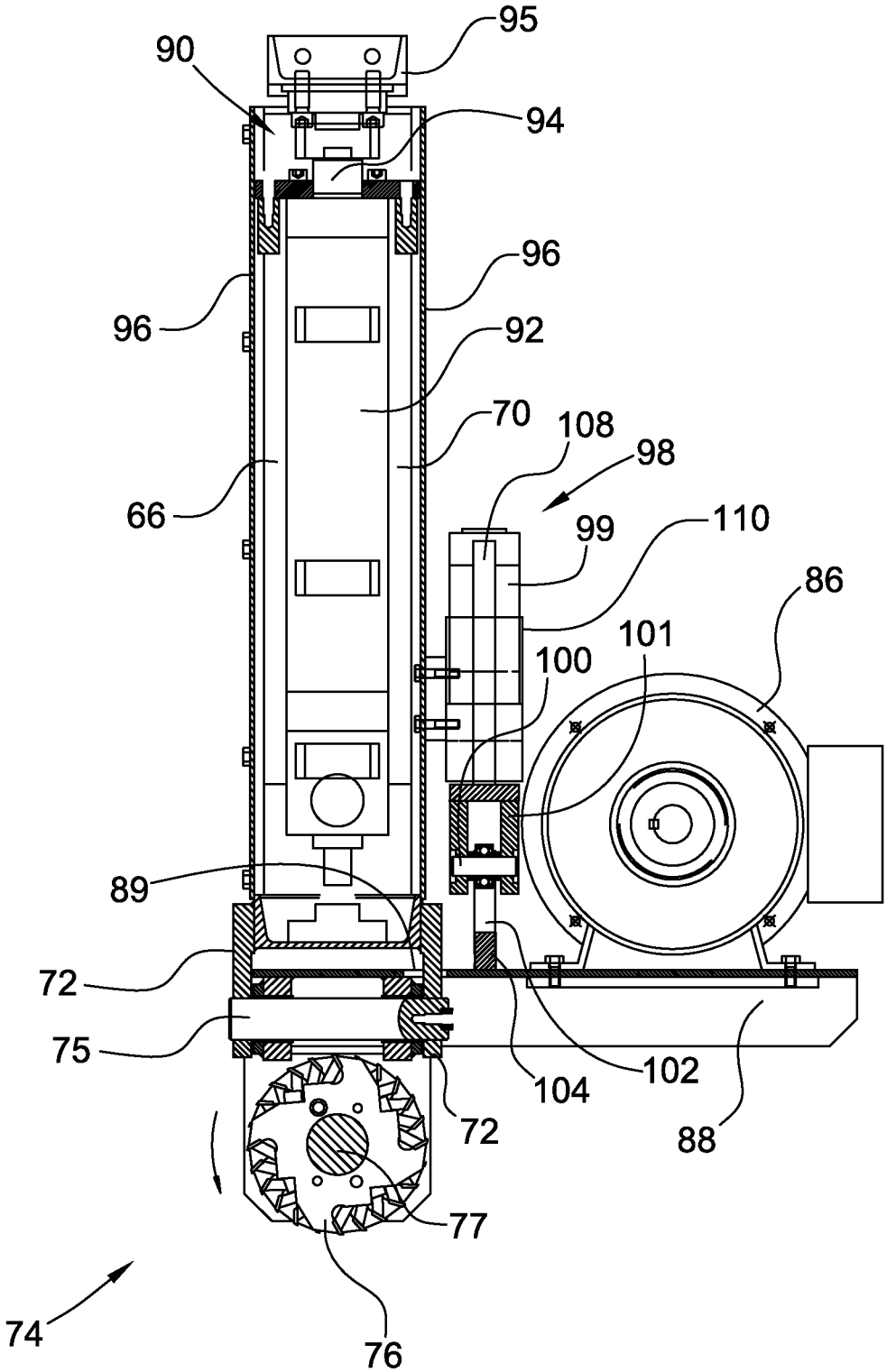
FIG. 8 is a cross-sectional view of the cutter assembly shown in FIG. 7.

Cutter assembly 18 is shown in FIGS. 7 and 8. It should be appreciated that cutter assembly 18, which lacks an 'A' or 'B' identifier is used to generally describe either of assemblies 18A or 18B, and that any reference numbers used in the description that also lack the 'A' or 'B' identifier also generally describe the respective 'A' and 'B' elements. For example, plate 72 generally describes both plates 72A and 72B, while frame 66 generally describes frames 66A and 66B, etc.

Accordingly, it can be seen that cutter head 74 is attached to plate 72, specifically via pin 75. As described in more detail infra, pin 75 enables cutter head 74 to "float" or rotate about pin 75 with a certain degree of freedom for improved cutting performance. That is, the floating pin enables cutter head 74 to rotate about the pin, so that the cutter assemblies can conform to the tapering or contours of the flitch being surfaced. For example, trees are naturally thicker at the bottom and taper towards the top, so flitches inherently include this tapering. The tapered end of the flitch is usually inserted into cutting section 14 first. Since the flitch is progressed through the cutting section one longitudinal increment at a time, the cutting assemblies would remove too much material, or possibly no material at all, if the cutter assemblies lacked the ability to float because the contours of a flitch typically do not remain consistent over the entire longitudinal length.

Cutter head 74 includes a plurality of cutter blades 76. Eighteen blades 76 are shown, but it should be appreciated that any number of blades could be used. The blades are arranged on shaft 77 forming a cutting width w, bounded by guides 78 and 80 on opposite sides of the blades. Specifically, the guides are formed as essentially rigid wheels on shaft 77, with guides 78 and 80 being a leading edge guide and a trailing edge guide, respectively. By leading edge guide, it is meant that guide 78 is first to encounter the flitch as the flitch is moved from the infeed to the outfeed through cutting section 14. In other words, the leading edge guide faces infeed 12, while trailing edge guide 80 faces outfeed 16. The guides basically act as stops for supporting the head against the flitch and accordingly limit the depth the cutter heads cut into the flitch.

That is, the purpose of the guides is to control the depth of the cut the cutter heads make into the flitch while the flitch is progressed through cutting section 14. This is accomplished by making leading edge guide 78 slightly recessed from cutter blades 76, as shown (see also enlarged example in FIGS. 12 and 13). Specifically, trailing edge guide 80 is made so that it aligns with the tips of the cutter blades. By making the leading guide slightly recessed from the cutter blades, the cutter blades will penetrate the flitch up to the point that both guides contact the surface of the flitch. Thus, the distance the leading guide is recessed from the blades defines the cutting depth of the cutting heads. This depth is typically up to approximately one eighth of an inch, although other depths are readily possible. By aligning the trailing edge guide with the tips of the blades, the cutter blades cut to the same depth as the previous cut as the flitch is progressed through the cutting section.

Drive wheel 82 is connected on shaft 77 for driving the shaft and therefore cutter blades 76. The drive wheel is connected by belt 84 to motor 86. Belt 84 and drive wheel 82 may be grooved for more securely coupling motor 86 to drive wheel 82. Cutter head 74 and motor 86 are commonly mounted on mounting platform 88. In this way, the motor will also rotate about pin 75 when the cutter head floats on the pin. By commonly rotating the cutter head and motor, for example, belt 84 will not be pulled off the drive wheel and/or motor output, such that the cutter blades can operate regardless of the rotational position of the cutter head about pin 75. Plates 72 do not interfere with the floating of the cutter head, for example, because the platform includes slots 89.

As described previously, plate 72 is rigidly secured to cutter frame 66, which is slidably engaged along rails 58 at sliding connections 70. Specifically, relative motion of frame 66 along rails 58 is achieved by use of extension device 90. Extension device 90 is functionally attached to cutter head 74 though floating pin 75 and acts to raise and lower cutter head 75. By raise and lower, it is meant to move the cutter head toward or away from the flitch in a radial direction relative to the flitch and/or axis Ax. By functional attachment is meant that the link between extension device 90 and cutter head 74 allows for control over the position of cutter head 74 through either a direct link, such as direct contact connection between the two components or an indirect link such as through plate 72 and floating pin 75.

In one embodiment, extension device 90 includes long stroke actuator 92, which is preferably a fluid operated cylinder using either compressed air or hydraulic fluid to move cutter head 74 (and motor 86, which is connected to the cutter head via mounting plate 88) towards and away from the flitch, such as before and after a flitch has been surfaced. Long stroke actuator 92 is secured at one end to plate 93. Short stroke actuators 94 may also be secured to plate 93 for moving the cutter heads slightly away from the surface of the flitch as the flitch is indexed between each cutting cycle. As can be seen in FIG. 7, the body of long stroke actuator 92 is connected only to plate 93, while the output rod is connected to cutter frame 66. Short stroke actuators 94 are connected between plate 93 and cross-beam 95, which is rigidly connected between rails 58. Thus, actuating either short stroke actuator 94 or long stroke actuator 92 sets the position of cutter frame 66 relative to rails 58, with the cutter frame sliding down the rails.

For example, it is easier to regulate and control the short stroke actuators for making small adjustments than it would be to constantly alter the stroke position of the long stroke actuator. Thus, in operation of apparatus 10, the long stroke actuator would start in a retracted position, away from the flitch. The long stroke actuator would then be actuated to bring the cutter head to contact against the flitch. For example, the long stroke actuator could be pressurized to a certain level and extended toward the flitch until the guides act to support the cutter head against the flitch. After the cutter heads have surfaced a strip of material from the flitch, the short stroke actuators are retracted slightly, pulling the cutter head away from the flitch, the flitch is indexed by a longitudinal distance equal approximately to width w of the cutter blades, and the short stroke actuators are actuated so that the cutter head engages against the flitch again. This is repeated until the flitch is completely surfaced, at which point the long stroke actuator is retracted for pulling the cutter head away from opening 46 such as to make room for another flitch, which may be of a different diameter. The entire process is then repeated for subsequent flitches.

Extension device 90 may be protected from wood chips or the like, on one or both sides by cover plates 96, which also act to generally reinforce cutter frames 66. Also, as shown in FIG. 8, cover plate 96 may also be used to connect locking mechanism 98 between cutter frame 66 and mounting platform 88. Specifically, actuator 99 is connected to frame 66, with the actuatable output rod of actuator 99 being connected to pin 100, for example via body 101. Pin 100 is engagable in wedge-shaped opening 102 of wedge plate 104, and the wedge plate is fixedly secured to mounting platform 88.

Figure 10:
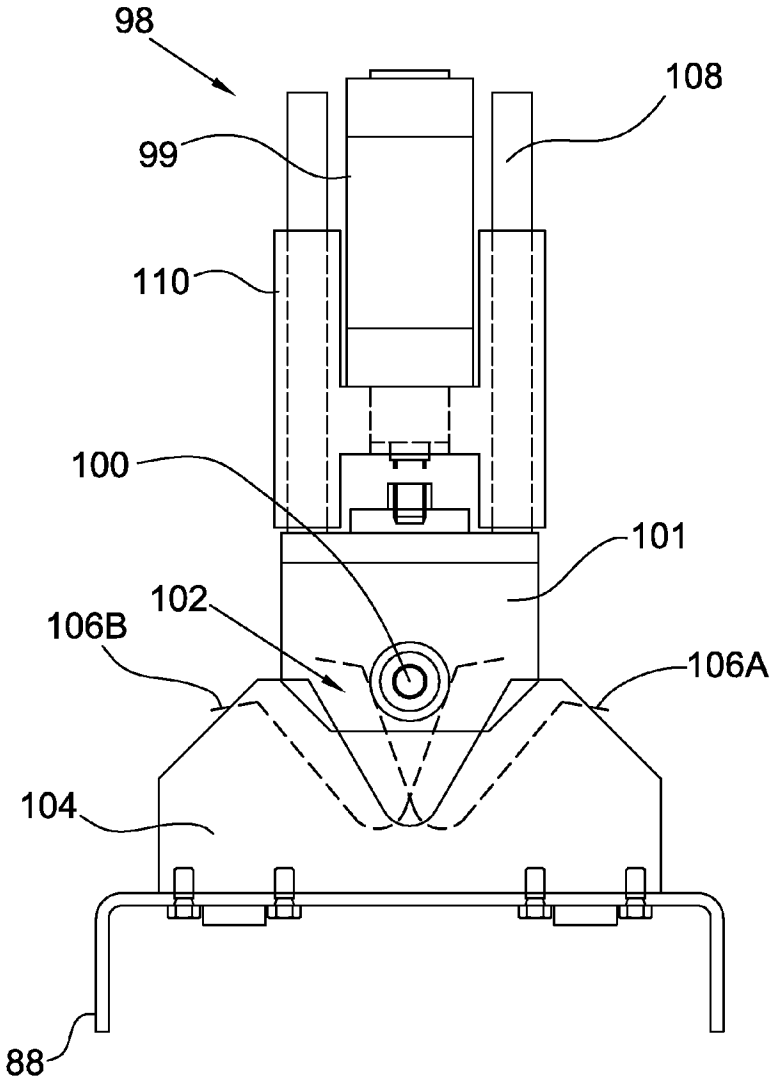
FIG. 10 is a front view of the locking mechanism of FIG. 9 in an unlocked position.
Figure 9:
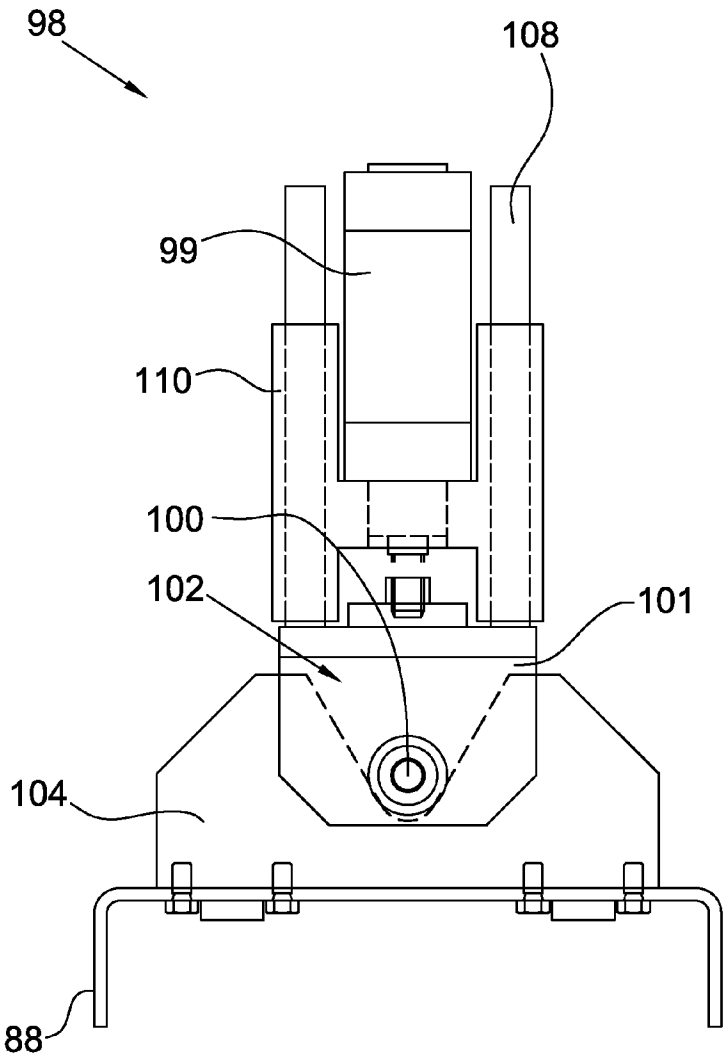
FIG. 9 is a front view of a locking mechanism for a cutter head apparatus in a locked position.

Locking mechanism 98 is shown in additional detail in FIGS. 9 and 10. Accordingly, the following is with respect to FIGS. 8-10. When locking device 98 is actuated downwards, that is, the piston rod of actuator 99 is extended towards mounting plate 88, locking pin 100 is forced into wedge-shaped opening 102 of wedge plate 104. When locking pin 100 is locked into wedge-shaped opening 102, such as shown in the position of FIG. 9, the locking device prevents platform 88, and therefore cutter head 74, from rotating about floating pin 75. That is, pin 75 is axially offset from pin 100, so rotation about or rotation relative to either pin is prevented. As shown in FIG. 10, pulling pin 100 out of the trough of wedge-shaped opening 102 by retracting the piston of actuator 99 enables rotation about pin 75 because clearance is formed on either side of pin 100 due to the sloped sides of the wedge-shaped opening. Specifically as shown in FIG. 10, pin 100 is positioned such that approximately 10° of rotation can occur by mounting platform 88 in either direction about pin 75, as indicated by positions 106A and 106B, at which position wedge plate 104 contacts pin 100. Thus, by setting pin 100 at various distances from the trough of wedge-shaped opening 102, different degrees of rotational freedom of platform 88, and therefore cutter head 74, are possible. In other words, it is possible to set the degree to which the cutter head is allowed to float via pin 75. For example, locking device 98 could be used to lock the cutter head in place for the first and last cleaning passes for each flitch. If the cutter head were not locked for the first and last cuts, for example, the head would likely rotate and chamfer the ends of the flitch, thereby wasting material, because the head would only be supported by one of the two guides. Body 101 may include additional support in the form of rods 108 which are slidably housed in channels in mounting member 110, to which mounting member actuator 99 is secured.

Figure 11:
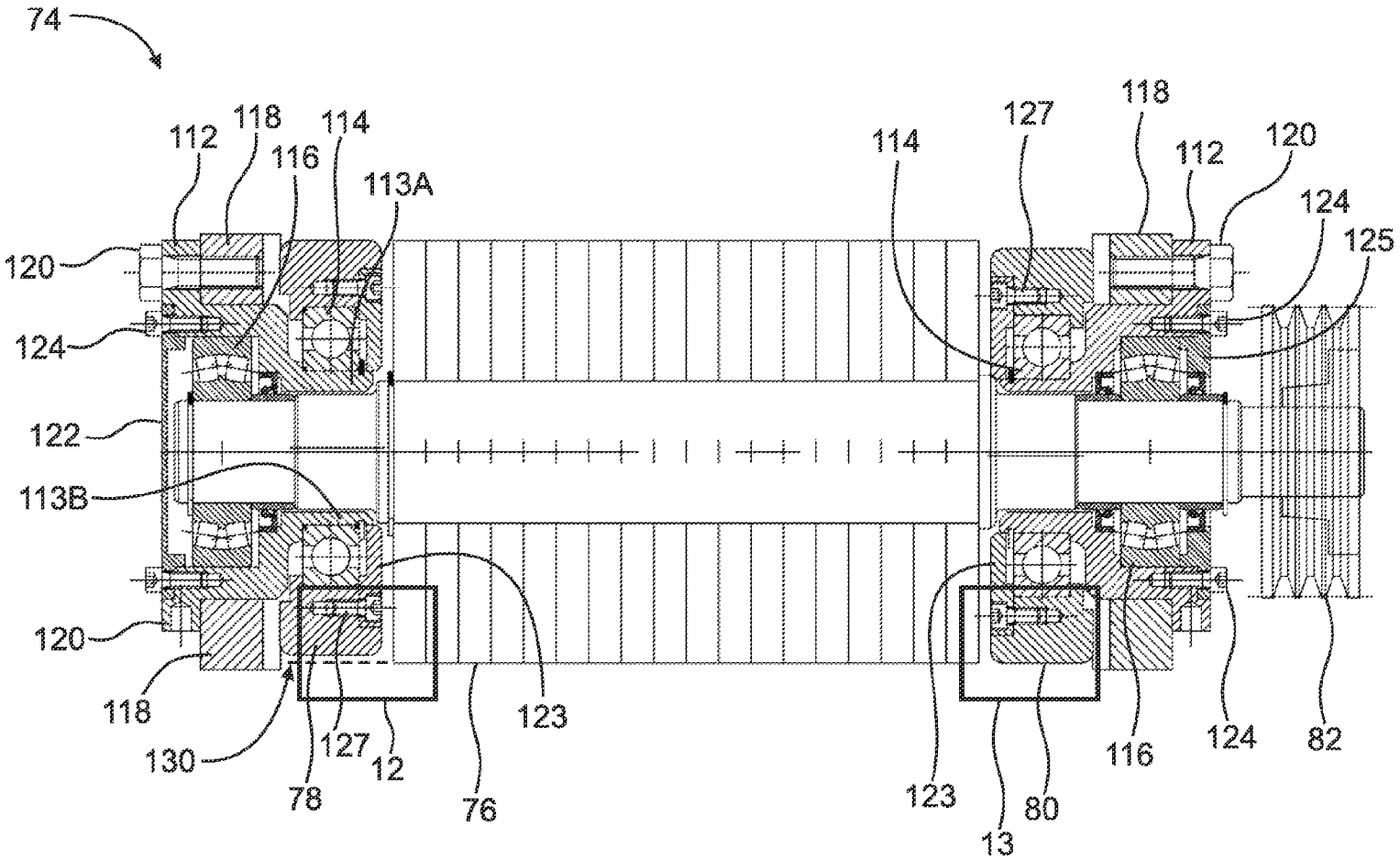
FIG. 11 is a cross-sectional view of a cutter head of the cutter assembly of FIG. 7.

A cross-sectional view of cutter head 74 is shown in FIG. 11. It can again be seen that blades 76 are mounted on shaft 77, which shaft includes drive wheel 82 mounted thereon. Guides 78 and 80 are shown on opposite sides of blades 76. For the sake of discussion, guide 78 is considered the guide on the infeed side, while guide 80 is the guide on the outfeed side, although it should be understood that the cutter heads and/or apparatus 10 could be installed or run in the opposite direction.

The following is in view of FIG. 11-16. Bushings 112 are mounted on shaft 77 with guides 78 and 80 mounted on the bushings. Specifically, guides 78 and 80 are mounted on flanges 113 of the bushings, and freely rotatable on their respective bushings due to bearings 114 included between the guides and the bushing, while the shaft is freely rotatable within the bushing due to bearings 116 which are included between the shaft and the bushings. The shaft runs through bore 115 in each bushing without interference, as the bushing is supported on the shaft primarily via bearings 116. The bushings, however, are rotatably locked in place because they are secured to non-rotatable rings 118 via bolts 120, or some other securing means. Ring 118 is secured, for example, to platform 88, thereby preventing rotational of ring 118 with respect to shaft 77. Bearing 116 on the leading side is held in place and generally protected by cover 122, which is secured to the bushing by bolts 124, while bearing 116 on the trailing side is held in place by cover 125 via bolts 124. That is, cover 125 generally resembles cover 122, but may need to be adapted to accommodate and support drive wheel 82 and shaft 77, which shaft runs through cover 125. Covers 123 are also included opposite to cover 122 or 125, with securing device 127 securing cover 123 to guide 78 or 80.

Figures 14, 15, 16:
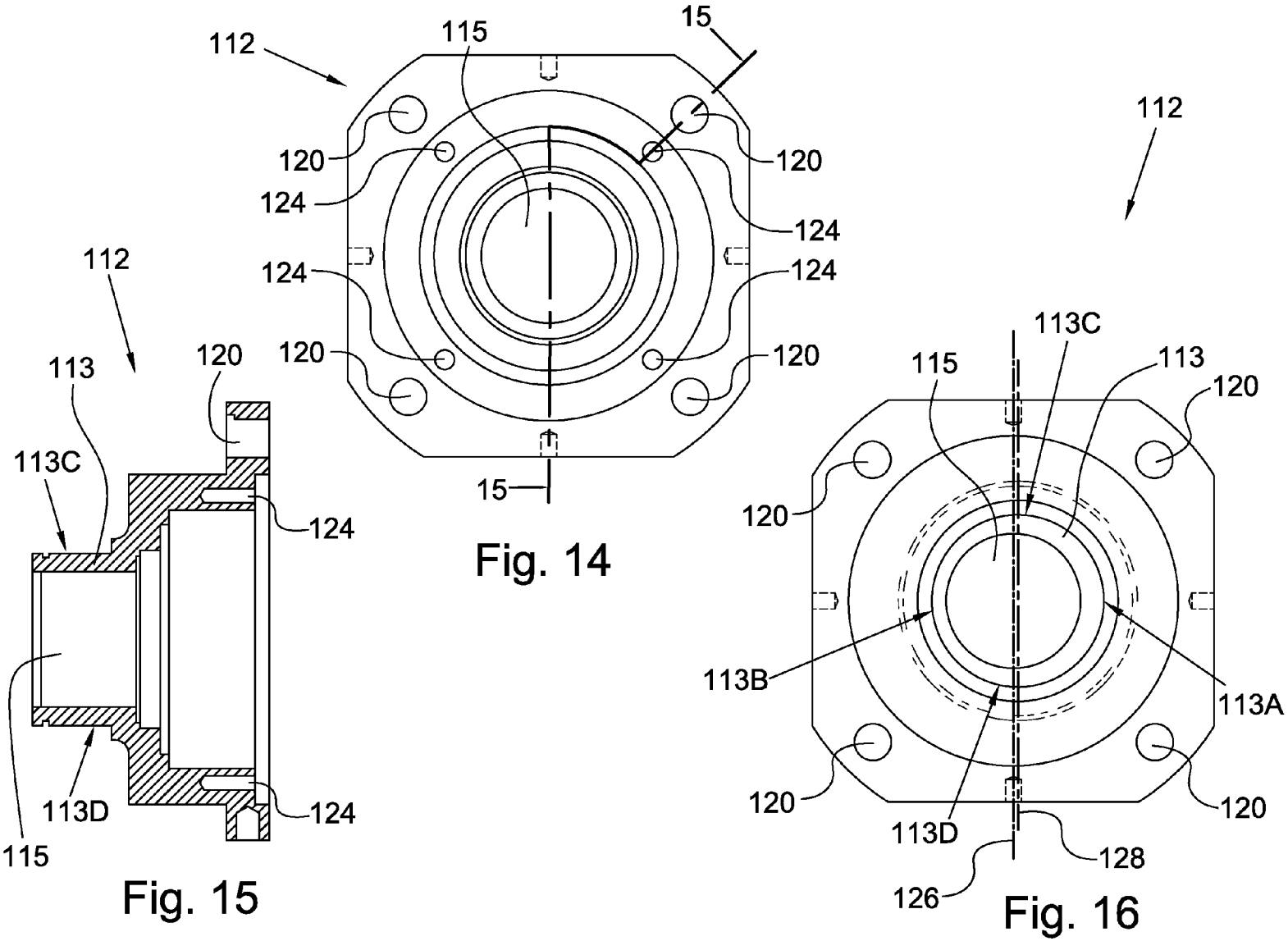
FIG. 14 is a front view of a bracket for the cutter head of FIG. 11.
FIG. 15 is a cross-sectional view of the bracket of FIG. 14.
FIG. 16 is a back view of the bracket of FIG. 14.

For clarity, a flange of the bushing over which each bearing 114 is fitted is designated with numerals 113A and 113B. That is, flange 113 is eccentrically formed about bore 115 of each bushing, and thus transitions from thick portion 113A to thin portion 113B circumferentially about the shaft. Specifically, as shown in FIGS. 14 and 16, bore 115, in which shaft 77 is inserted, is centered in bushing 112 while the flange is eccentrically formed so that the flange is thicker on one side than the other. Specifically, the eccentricity can be seen in FIG. 16 as the difference between true centerline 126, which defines the center of the bushing and eccentric centerline 128, which defines the center of flange 113.

The eccentricity changes the radial position of each guide with respect to shaft 77. That is, the guide will be axially offset from the shaft, and therefore the guide will be axially offset with respect to the blades. This is important because the blades of the cutter head are arranged to contact the flitch only at a certain rotational position. Particularly, with respect to each of the Figures that show the cutter assemblies, this rotational position where the blades contact the flitch is generally the bottom most edge of the cutter head. Thus, for example with respect to FIG. 11, the blades of the cutter head will cut into the flitch only when the tips of the blades pass by their bottom most position, as indicated by line 130. That is, cutting surface, edge, or line 130 is formed essentially tangentially at the bottom of the rotation of the cutter blades so that the cutting blades cut into the flitch only when the tips of the blades pass tangentially by the cutting surface. Accordingly, by positioning the bushing such that thicker or thinner portions of the flange of the bushing are radially aligned with cutting surface 130, the cutting depth of the cutter head can be controlled. By radially aligned, it is meant that a radial line can be drawn from the center of the shaft through both the portion of the flange and the cutting line. In other words, the flange portion faces (or is closest to) cutting line 130.

Figure 13:
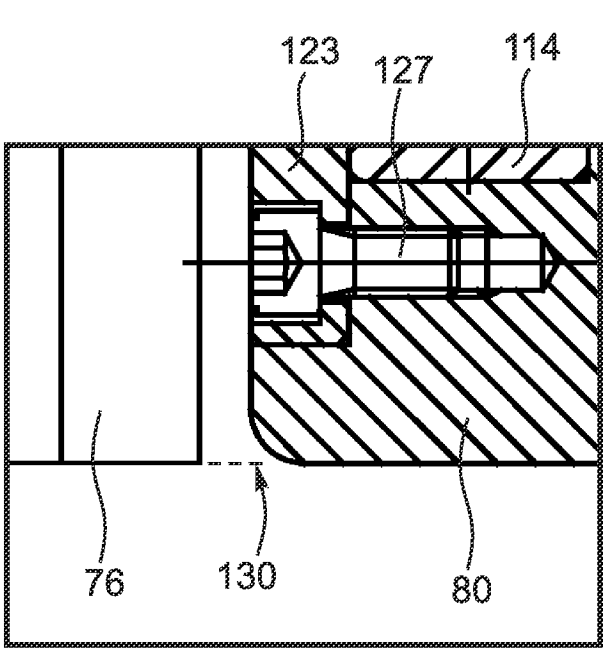
FIGS. 12 and 13 are enlarged views of the cutter head of FIG. 11 illustrating an eccentricity of the cutter head.
Figure 12:
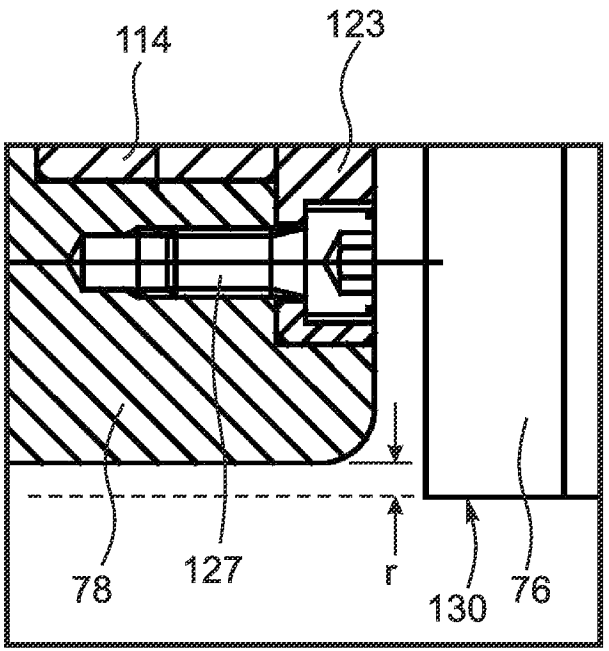

That is, the eccentricity enables creation of a small radial offset between a portion of the outer surface of the guide (the portion directly radially aligned with surface 130) and the tips of the blades (surface 130), which radial offset is designated in FIG. 12 as distance r. As described above, this radial offset defines the cutting depth of the cutter heads. Since the bushing is eccentrically mounted on shaft 77, this radial offset (distance r) is not created about the entire circumference of the guide. Instead, the radial offset is greatest in a circumferential portion of the cutter head radially aligned with the thinnest portion of the flange, and smallest in a circumferential portion of the cutter head radially aligned with the thickest portion of the flange. As shown in FIGS. 11 and 13, trailing guide 80 is set such that thick portion 113B of the flange is aligned radially with surface 130 such that the outer surface of guide 80 falls along cutting surface 130, thereby enabling each successive cut to be even with each previous cut, as described previously.

In prior art devices, it was necessary to disassemble the entire cutting head and replace the leading guide with a guide having a smaller outer radius, since it is the distance that the guide is recessed from the tips of the blades that defines the cutting depth. The process of disassembling and reassembling these cutter heads could typically take several hours, due to the complexity of the heads. Advantageously, according to the current invention, it only takes a few minutes to change the cutting depth. That is, it should thus be understood that by changing the rotational orientation of the bushing, the axial alignment of the respective guide, with respect to the shaft, is shifted for enlarging or reducing the radial offset that defines the cutting depth. As discussed above, the leading guide should be recessed a radial distance equal to the cutting depth, while the trailing guide should be set so that there is no radial difference between the trailing guide and the tips of the blades. Specifically, once bolts 120 are loosened, the bushing (including cover 122 or 125, depending on the bushing) can be rotated about the shaft, to change the rotational orientation of the bushing. Effectively, this changes the thickness of the portion of flange 113 that is aligned with the cutting surface, and therefore changes the axial alignment (or misalignment) of the guide with respect to the shaft, which axial alignment (or misalignment) sets the radial offset that ultimately defines the cutting depth. Bolts 120 are then retightened to secure the bushing to rotationally fixed ring 118 at the new desired orientation. Due to there being four bolts 120, the bushing can take four different rotational positions or orientations with respect to cutting surface 130. Namely, any of flange portions 113A, 113B, 113C, or 113D could be aligned to face the cutting surface, resulting in four possible rotational positions of bushing 112. It should be appreciated that in this embodiment the eccentricity is only set in one direction (i.e., towards the right in FIG. 16), so that selecting positions corresponding to flange portions 113C or 113D would result in the same cutting depth. For example, the cutting depths associated with flange portions 113A-113D could be ⅛", 0", 1/16", and 1/16", respectively. It should be appreciated that eccentricity could be in more than one direction, or that more bolts could be included in other polygonal arrangements for enabling a finer degree of control over the cutting depth. It should be recognized that eccentric bushings could be fabricated to cut at different depths than those indicated herein, and may be manufactured to similarly allow an almost infinite range of cutting depths between a predetermined minimum and maximum depth. It should also be appreciated that only one eccentric bushing need to be supplied, namely on the leading edge, but using two eccentric bushings enables flitches to be run through apparatus 10 in either direction, for the parts to be interchangeable or made by the same mold/tooling, etc.

Figure 17:
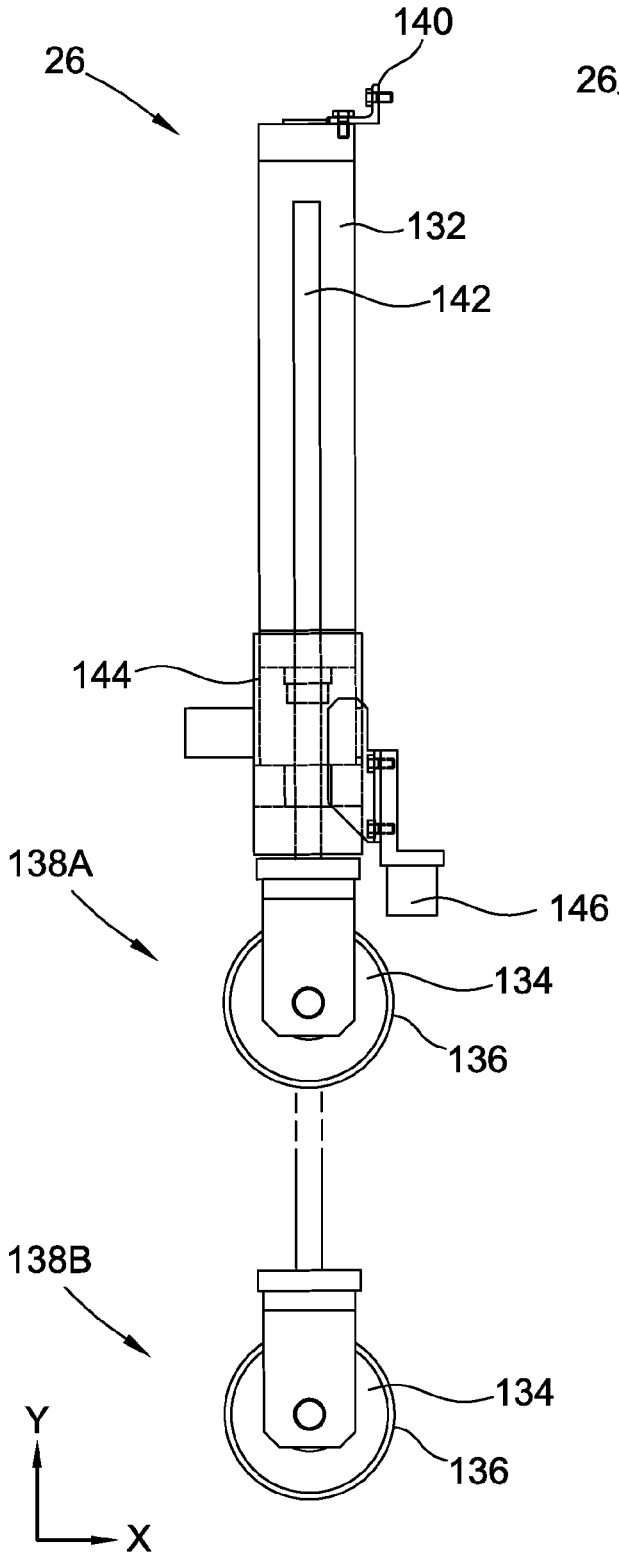
FIG. 17 is front view of a hold-down arm for holding a flitch.
Figure 18:
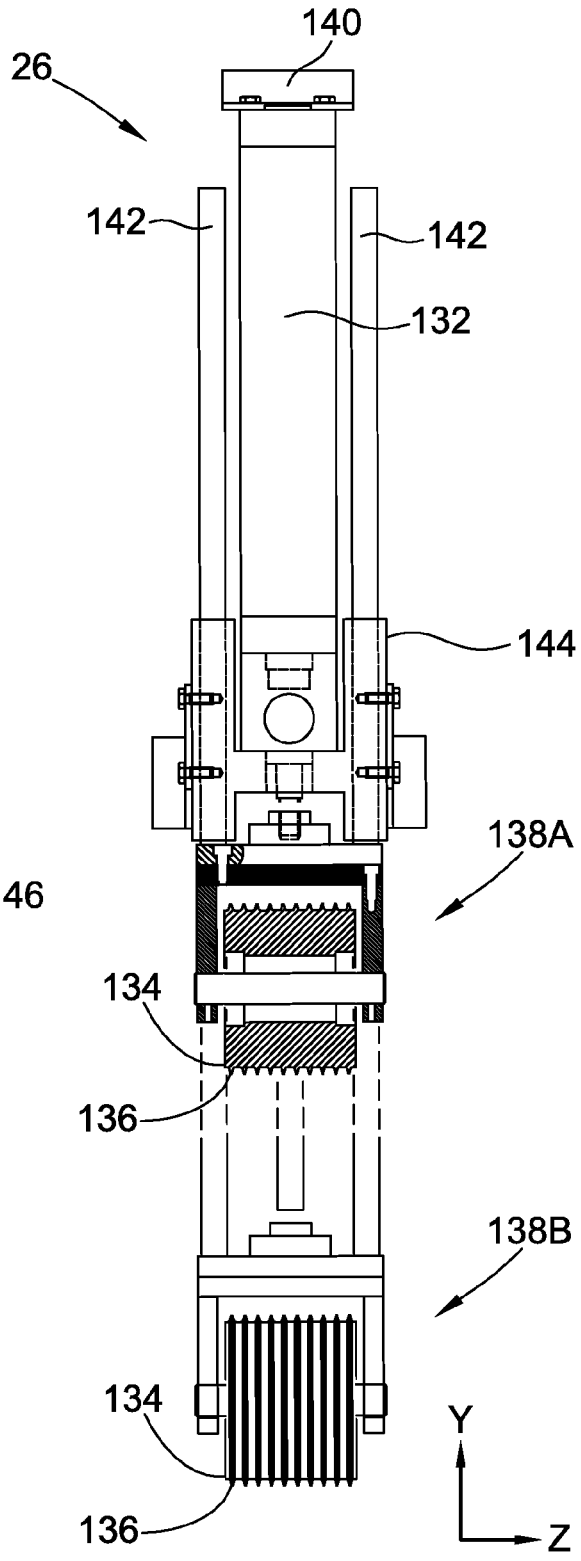
FIG. 18 is a side view of the hold-down arm of FIG. 17 with the roller head of the hold-down arm shown cross-sectionally.

Hold-downs 26 are shown in more detail in FIGS. 17 and 18. Hold-downs 26 each include actuator 132 which is functionally connected to roller head 134. The roller heads include ribs 136 to increase friction between the flitch and the roller heads. It has been generally found that flatter, wider ribs work better than sharp or pointed ribs, and the sharp ribs tend to damage the flitch as it passes through apparatus 10 and do not provide as much friction, although any suitable head could be included for holding down the flitch. Actuator 132 extends the roller heads, for example, from retracted position 138A to extended position 138B, or until the roller head contacts the flitch while being extended toward position 138B. The roller heads are rotatable so that the flitches can be moved in the x-direction without having to retract the hold-downs. The hold-downs are connected to beam 28 or other suitable structure, for example, via brackets 140. Rods 142 may be included and slidable in body 144 for providing additional support to hold-down 26. The hold-downs may include sensors 146, for example, to detect when the flitch passes underneath to determine when they should be automatically deployed. Motion sensors, such as photoelectric, optical, or infrared sensors are well known in the art, and any suitable sensor could be used to detect the position of the flitches. A similar sensor could be used to automatically sense when the flitch is in position to be cleaned. That is, the end of the flitch is aligned with the cutter head.

Figure 19:
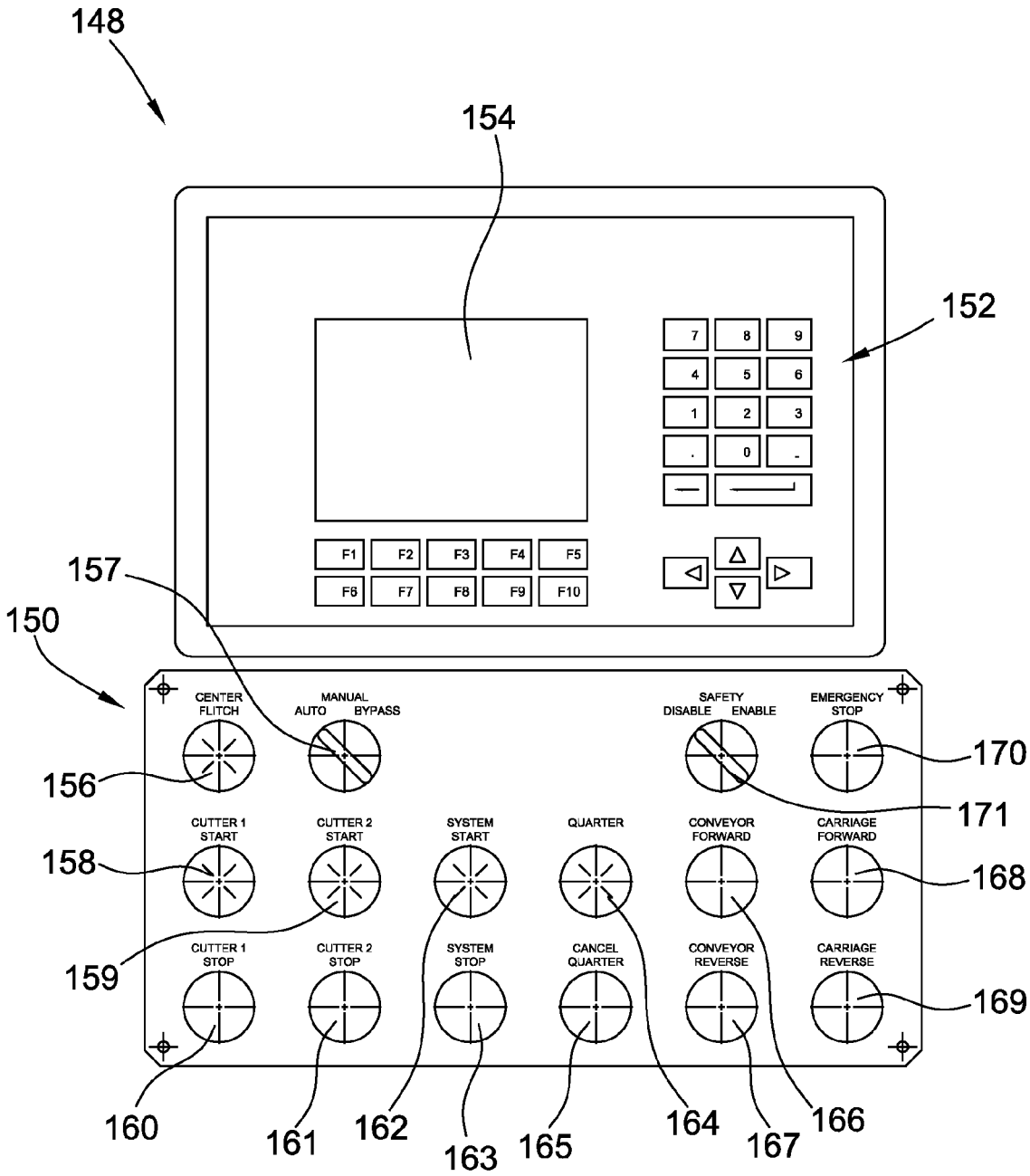
FIG. 19 is a front view of a control panel for operating the flitch surfacing machine of FIG. 1; and, FIG. 20 is a perspective view of a support device for supporting a half-flitch in the cutting section of the flitch surfacing apparatus of FIG. 1.

FIG. 19 shows control unit 148 which is in communication with apparatus 10 for controlling the operation of the apparatus. Specifically, unit 148 includes pushbutton panel 150 and operator interface unit 152, which includes display screen 154. Control panel 152 is for enabling a user to communicate with controlling unit 148, such as to modify parameters of apparatus 10 or observe fault or status messages. For example, using the buttons in unit 152, it could be possible to manually cycle the hold-downs, manually extend and retract the cutter heads, etc. Pushbutton station 150 contains a plurality of buttons and switches for triggering operation of the various components of apparatus 10.

For example, a user could begin by pressing button 156 to trigger operation of centering devices 24 in centering assembly 22. This may also act as a reset to reset any fault that may have stopped operation of apparatus 10 during a previous cycle. The user would then be able to set a manual, automatic, or bypass mode of operation with switch 157, which controls how the apparatus 10 operates, such as in response to inputs into operator interface unit 152 and pushbutton station 150. In an automatic mode, all other buttons may be deactivated, for example, except for the start and stop buttons, while an operator could manually trigger activation of various components by pressing the relevant buttons as described below.

Buttons 158 and 159 are arranged to manually start the cutter heads (e.g., activate motor 86 to spin shaft 77 and blades 76) for cutter assemblies 18A and 18B, respectively, while buttons 160 and 161 are arranged to stop the cutter heads for assemblies 18A and 18B, respectively. Button 162 is arranged to start operation, such as automatic operation, of the system. For example, this could activate centering assembly 22, for example, by extending the output of actuator 38 to bring cassettes 30 and 31 in position 40A on rails 32, then powering the cassettes with actuator 34 to center the flitch. Once centered, the actuator would be deactivated to retract devices 24 into position 40B. Then the conveyors would be driven to move the flitch into cutting section 14, where a sensor, such as sensor 146, would detect if the flitch is properly positioned for cleaning Hold-downs 26 would also be deployed automatically when it is sensed that the flitch passes underneath, but not until after the centering has occurred.

Next, locking device 98 is activated to drive pin 100 into wedge-shaped opening 102 to lock the orientation of the cutter head as previously described so that the end of the flitch is not chamfered off. Then extension device 90, particularly long stroke actuator 92, is actuated to contact cutter head 74 against the flitch. The carriage is then driven 90 degrees along track 54 by motor 60 such that cutter assemblies 18A and 18B, which are 90 degrees apart, are simultaneously driven around the outer circumferential surface of the flitch for cleaning the full 180 degree semicircular surface of the flitch, with each cutting assembly cleaning approximately one half of the outer surface of the flitch. Long stroke actuator 92 is locked at this position, and short stroke actuators 94 are retracted to pull cutter heads 74 away from the flitch. Locking actuator then retracts pin 100 a suitable amount to enable the cutter head to float about pin 75. The flitch is also indexed in the x-direction by a distance equal approximately to width w of the blades of each cutter head. The short stroke actuator is then extended and the long stroke actuator unlocked to enable cutter heads 74 to again contact flitch F. Trailing guide 80 should be set generally flush with the tips of blades 76 so that each cut success cut is flush with the previous cut. The carriage is then driven to carry the cutter heads 90 degrees in the opposite direction about the flitch to remove a second longitudinal strip of material from the flitch. The process of retracting short stroke actuators 94, locking long stroke actuator 92, and indexing the flitch, extending the short stroke actuators, unlocking the long stroke actuator, and driving the carriage is repeated down the entire length of the flitch, until it is detected by the sensors that the remaining portion of the flitch is approximately less than width w, indicating one last cut is needed. As the cleaned portion of the flitch is moved into outfeed section 16, the hold-downs are automatically deployed when the flitch is detected by sensors. Likewise, hold-downs in the infeed section are retracted when the flitch is no longer detected. For example, apparatus 10 may detect when a last cut is needed when no sensors on the hold-downs on the infeed side can detect the flitch. For the last cut, the locking actuator locks the floating ability of the cutter head. After the last cut, the hold-downs are all retracted, even on the outfeed side, and the flitch is carried out of the cleaning section by conveyors 20. Generally, this entire process would all happen automatically by apparatus 10.

Buttons 164 and 165 could be used to select or deselect a mode of operation for a half-flitch, which should be set before the system is started. For example, this would communicate to apparatus that actuator 44 should be used to deploy pin 42 for centering a half flitch, or for apparatus 10 to activate half-flitch support device 29, as described infra. If half-flitch mode is not selected, then actuators 44 and 174 will not activate, for example.

Buttons 166 and 167 could be used to manually jog a flitch forward and backward, respectively, by powering conveyors 20 in forward and reverse. This could be used in case a sensor malfunctions, to re-clean a section of the flitch, etc. Buttons 168 and 169 could be used to jog carriage 52 forward and reverse along track 54, for example, if apparatus 10 was stopped mid-cycle due to a fault or operator input.

Button 170 could be used as an emergency kill switch for immediately stopping all components of the system in order to avoid damage to the system during a fault or injury to an operator. Switch 171 could be used to enable a safety mode, where, for example, all components would be de-energized. This could, for example, be used by maintenance personnel to turn off the system and ensure that another user or operator could not inadvertently trigger operation of any component of apparatus 10 while the maintenance personnel are working on the apparatus.

Generally, the hold-downs exert sufficient force on the flitch to keep the flitch from shifting position during the surfacing operation of cutter assemblies 18. That is, extension device 90 may extend the cutter head against the flitch until both guides 78 and 80 are firmly pressed against the surface of the flitch with a certain pre-determined pressure, and the hold-downs act to hold the flitch against the conveyors so that the force exerted by the extension device does not overly shift the position of the flitch. While rotating the cutter heads around the flitch, the flitch will tend to move back and forth generally in the z-direction due to the changing angle at which extension devices 90 are pressing against the flitch during rotation about the flitch by carriage 52. However, with the inclusion of two cutter assemblies (e.g., assemblies 18A and 18B), the flitch is generally re-centered during each pass. That is, for example, a first cutter assembly is initially pressing generally downward (which does not shift the position of the flitch), while a second cutter assembly is pressing substantially in the z-direction against the flitch, which may shift the position of the flitch. As the carriage carries the cutter heads around the flitch, the first cutter assembly transitions so that it presses in the opposite z-direction, essentially re-centering the flitch, while the second assembly finishes by pressing downwards on the flitch.

However, half-flitches are only acted on by one cutter assembly, because the outer circumferential surface of the half-flitch spans only 90 degrees. Therefore, the half-flitches are constantly being acted on in the same z-direction by cutter heads 74, which can tend to push half flitches out of alignment with axis Ax, resulting in poor cleaning of half-flitches. Furthermore, since the half-flitch is only located on one side of axis Ax, only half of the roller heads of hold-downs 26 are acting on the flitch. Accordingly, similar to actuator 44 and semi-circular pin 42 of FIGS. 3 and 4, device 29 may be provided as stop mechanism to engage against the vertical flat surface of the half-flitch for preventing misalignment of the half-flitch when subjected to forces in the z-direction from the cutter head. Specifically, head 176 on the end of the piston rod of actuator 174 protrudes from support bracket 172. Head 176 is approximately aligned, such as tangentially, with Ax such that the head, supported by bracket 172, prevents the half-flitch from becoming overly misaligned with respect to axis Ax. Actuator 174 is simply not activated if a normal flitch is being processed, and bracket 172 is low enough not to interfere with the progress of flitches over device 29.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What is claimed is:

1. A cutter head for removing an outer circumferential surface of a flitch, said outer circumferential surface resembling a semicircle in cross-section, said cutter head comprising:

a shaft;

a blade mounted on said shaft, wherein material of said flitch is removable by said blade by rotating said shaft when said blade is engaged against said flitch;

at least one bushing including a bore therethrough, wherein said shaft runs through said bore, wherein a flange is eccentrically formed about said bore on said at least one bushing;

a leading guide mounted on said flange of said at least one bushing, wherein said flange axially offsets said leading guide with respect to said shaft, wherein said guide is operatively arranged to support said cutter head against said flitch while said cutter head is removing said outer circumferential surface; and, wherein a radial distance between a tip of said blade and said leading guide at least partially determines a cutting depth that said cutter head cuts into said flitch, and wherein due to said flange being eccentrically formed about said bore and said guide being mounted on said flange, said radial offset is determined based on a rotational orientation of said at least one bushing about said shaft.

2. The cutter head in claim 1, wherein said at least one bushing comprises first and second bushings, wherein said leading guide is mounted on said first bushing and a trailing guide is mounted on said second bushing.

3. The cutter head recited in claim 2, wherein said trailing guide is arranged substantially flush with said tip of said blade.

4. A cutter assembly including the cutter head according to claim 1, wherein said cutter head is mounted on a platform.

5. The cutter assembly recited in claim 4 wherein said shaft is coupled to a motor for rotating said shaft, and wherein said motor is mounted on said platform.

6. The cutter assembly of claim 4 wherein said cutter head is attached to a cutter frame via a float pin, wherein said float pin is arranged substantially perpendicular to said shaft and enables said cutter head to rotate in order for said cutter head to follow longitudinal contours of said flitch.

7. The cutter assembly of claim 6 wherein a locking device is included between said cutter frame and said cutter head for limiting rotation of said cutter head about said float pin.

8. The cutter assembly of claim 7 wherein said locking device includes an actuator secured to said cutter frame and a plate having a wedge-shaped opening functionally secured to said cutter head, wherein said actuator is operatively arranged to set a position of a locking pin relative to said wedge-shaped opening, wherein said position of said locking pin with respect to said wedge shaped opening defines how far said cutter head can rotate about said float pin.

9. The cutter assembly of claim 6 wherein said cutter frame includes a first long stroke actuator and at least one second short stroke actuator for moving said cutter head towards and away from said flitch.

10. An apparatus for surfacing a flitch including at least one cutter assembly as recited in claim 4, said apparatus comprising:

an infeed section including a centering device for centering said flitch in said apparatus along a longitudinal axis;

an outfeed section for holding said flitch after it has been surfaced; and, a cutting section for surfacing said flitch, wherein said cutting section includes:

a carriage arranged to travel along a substantially semicircular track, said semicircular track concentrically aligned with said flitch and said longitudinal axis, wherein said at least one cutter assembly is secured to said carriage and operatively arranged to surface said flitch as said carriage traverses along said semicircular track.

11. The apparatus recited in claim 10 wherein said at least one cutter assembly includes first and second cutter assemblies, wherein said first and second cutter assemblies are secured to said carriage such that said first and second cutter assemblies are arranged substantially perpendicular to each other.

12. The apparatus recited in claim 11 wherein said first and second cutter assemblies simultaneously surface said outer circumferential surface of said flitch, and wherein said carriage travels approximately 90 degrees along said semicircular track for surfacing essentially an entirety of said outer circumferential surface of said flitch, with each of said first and second cutter assemblies surfacing approximately one-half of said outer circumferential surface of said flitch.

13. The apparatus recited in claim 10 wherein said cutter head of said cutter assembly is mounted on a platform and coupled to a motor for rotating said shaft of said cutter head, and wherein said motor is also mounted on said platform.

14. The cutter assembly of claim 13 wherein said cutter head is attached to a cutter frame via a float pin, wherein said float pin is arranged substantially perpendicular to said shaft and enables said cutter head to rotate in order for said cutter head to follow longitudinal contours of said flitch.

15. The cutter assembly of claim 14 wherein a locking device is included between said cutter frame and said cutter head for limiting rotation of said cutter head about said float pin.

16. The cutter assembly of claim 15 wherein said locking device includes an actuator secured to said cutter frame and a plate having a wedge-shaped opening functionally secured to said cutter head, wherein said actuator is operatively arranged to set a position of a locking pin relative to said wedge-shaped opening, wherein said position of said locking pin with respect to said wedge shaped opening defines how far said cutter head can rotate about said float pin.

17. The cutter assembly of claim 16 wherein said cutter frame includes a long stroke actuator and a pair of short stroke actuators for moving said cutter head towards and away from said flitch, wherein said long stroke actuator is actuated to initially bring said cutter head against said flitch and to finally bring said cutter head away from said flitch after said flitch is fully surfaced, and wherein said pair of short stroke actuators is actuated to pull said cutter head a set distance away from said flitch after each traversal of said carriage along said semicircular track and to push said cutter head back toward said flitch by said set distance after each indexing of said flitch before a subsequent traversal of said carriage along said track.

18. The cutter assembly of claim 10 wherein said cutting section includes a stop pin arranged at least partially or tangentially on said longitudinal axis for preventing a shifting of said flitch out of alignment with said longitudinal axis while said flitch is being subjected to forces by said cutter head as said carriage traverses said semicircular track about said flitch.

* * * * *